US006354208B1

(12) United States Patent
Bos et al.

(10) Patent No.: US 6,354,208 B1
(45) Date of Patent: Mar. 12, 2002

(54) PLATE HANDLING METHOD AND APPARATUS FOR IMAGING SYSTEM

(75) Inventors: Jan Bos, Ter Apel (NL); Frans Hammersma, Suffolk (GB); Robert Tetreault, Tewksbury, MA (US); John Williams, Derry, NH (US)

(73) Assignee: AGFA Corporation, Wilmington, MA (US)

( * ) Notice: Subject to any disclaimer, the term of this patent is extended or adjusted under 35 U.S.C. 154(b) by 0 days.

(21) Appl. No.: 09/571,679

(22) Filed: May 15, 2000

(51) Int. Cl.[7] ..... B41M 5/00; B41L 47/14
(52) U.S. Cl. ..... 101/463.1; 101/477; 101/401.1
(58) Field of Search ..... 101/463.1, 477, 101/401.1, DIG. 35, 483; 271/3.14, 10.01, 65

(56) References Cited

U.S. PATENT DOCUMENTS 4,040,616 A * 8/1977 Clarkson et al. ..... 271/65
4,334,472 A 6/1982 Back et al.
4,462,678 A 7/1984 Back
4,907,706 A 3/1990 Henderson
5,176,081 A * 1/1993 Buus ..... 101/477
5,255,607 A * 10/1993 Nishiyama et al. ..... 101/463.1
5,327,194 A * 7/1994 Doi et al. ..... 101/477
5,456,174 A * 10/1995 Hung et al. ..... 101/477
5,738,014 A * 4/1998 Rombult et al. ..... 101/477
5,887,525 A * 3/1999 Okamura et al. ..... 101/401.1
5,938,187 A * 8/1999 Conlan et al. ..... 271/3.14
6,006,670 A * 12/1999 Bantlin et al. ..... 101/DIG. 35
6,042,101 A * 3/2000 Menard et al. ..... 271/10.01
6,076,464 A * 6/2000 Okamura ..... 101/401.1

OTHER PUBLICATIONS

Nita Inc. Graphic Arts Equipment—Brochure (undated).
Techno–Grafica GmbH—Brochure (undated).

* cited by examiner

*Primary Examiner*—Eugene Eickholt
(74) *Attorney, Agent, or Firm*—Edward L. Kelley; Joseph D. King

(57) ABSTRACT

The invention provides a plate handling system for use in an imaging system in which plates of recording media are fed through an imaging unit. The plate handling system includes an input portion for receiving a plate from the imaging engine, a first conveying assembly, a second conveying assembly, an intermediate portion and an output portion. The first conveying assembly extends from the input portion to the intermediate portion, and is provided to direct a plate along a first direction. The second conveying assembly extends toward the output portion of the plate handling system, and is provided to direct a plate along a second direction from the intermediate portion to the output portion. The second direction is generally perpendicular to the first direction.

33 Claims, 18 Drawing Sheets

PLATE HANDLING METHOD AND APPARATUS FOR IMAGING SYSTEM

BACKGROUND OF THE INVENTION

The invention relates to the preparation of printing plates for mounting onto a printing press and particularly to the transport and automatic handling of the printing plates after recording an image onto the printing plates by a recording device.

Pre-press devices, e.g. imagestters and platesetters record images onto printing plates according to image information provided by electronic image files. Electronic image files may be prepared and processed by a front-end computer system, such as a server or workstation, operated by a pre-press operator. A printing job may include one printing plate having a single image recorded thereon or the printing job may include a plurality of related printing plates each having a different image or a different portion of the printing job recorded thereon. For example, when printing a color reproduction of a color original image, a separate printing plate may be required for separately printing each color of the original image.

More recently, recording devices have become automated. An automatic plate loading system may be interconnected with the recording device to provide access to various plate types automatically. For example, plates with different length and width dimensions for accommodating different size images and plates of different thickness', for accommodating different printing reproduction requirements may be stored in an automated plate handler. Accordingly, a plate type required by the printing job might be selected at the front-end and automatically loaded by the automated plate handler into the recording device for recording the image onto the selected plate type. An electronic designation signal designating the plate type may therefore be included within or provided in addition to the electronic image file sent from the front-end to the recording device.

Most printing plates require further processing after an image is recorded onto the printing plate by the image recording device. For example, when the recording media includes a photochemical image-recording layer, further processing may comprise a chemical-developing step. A chemical developer or plate processor may also perform other finishing steps such as washing and drying. On-line chemical developers attached directly onto the output end of the image recording device automatically receive plates from the image recording device and transport the plates through the chemical developer while performing the processing steps automatically. The plates exit the chemical developer onto a tray for storage until needed. More recently, other plate types having different image layers and requiring different after imaging processing steps have been made available. These plate types may require a different plate processing device for receiving the plates after imaging by a recording device.

One example of a prior art pre-press system is shown in FIG. 1. A computer-to-plate imaging system 10 includes a front-end server 12, a raster image processor 14, and a platesetter recording device 16. Printing jobs in the form of electronic image files are prepared at the front-end server 12 and communicated to a raster image processor (RIP) 14. RIP 14 formats the electronic image files for recording by the recording device 16 and communicated rasterized electronic image files thereto. The RIP 14 may be incorporated within the front-end 12.

Platesetter 16 comprises an electronic controller 30 for receiving electronic image files from the RIP 14 or front-end 12 and for coordinating the operation of the platesetter 16 and a plate recording device 20 for recording an image onto a plate. The recording device may be hand loaded with printing plates or automatically fed by an automatic plate manager 18. Plate manager 18 stores a plurality of printing plates of one or more plate types in one or more plate storage cassettes 24. According to the present example of the prior art plates a single plate is selected from the access position by a plate transport device 28 from a cassette 24 to the recording device 20. The platesetter 16 may also include an automated plate processor 22 for receiving the imaged plates from the recording device 20 and chemically or otherwise processing the plates to further enhance the recorded image. The prior art example of FIG. 1, is sold by Agfa Corporation of Wilmington, Mass. USA, under the trade name GALILEO. The plates handled by the prior art example range in size from about 450×368 mm, (17.72×14.5 in.) up to about 1130×820 mm (44.5×32.29 in.).

BRIEF DESCRIPTION OF THE DRAWINGS

The following description may be further understood with reference to the accompanying drawings in which.

The drawings are shown for illustrative purposes only, and are not to scale.

DETAILED DESCRIPTION OF THE INVENTION

Figure 2:
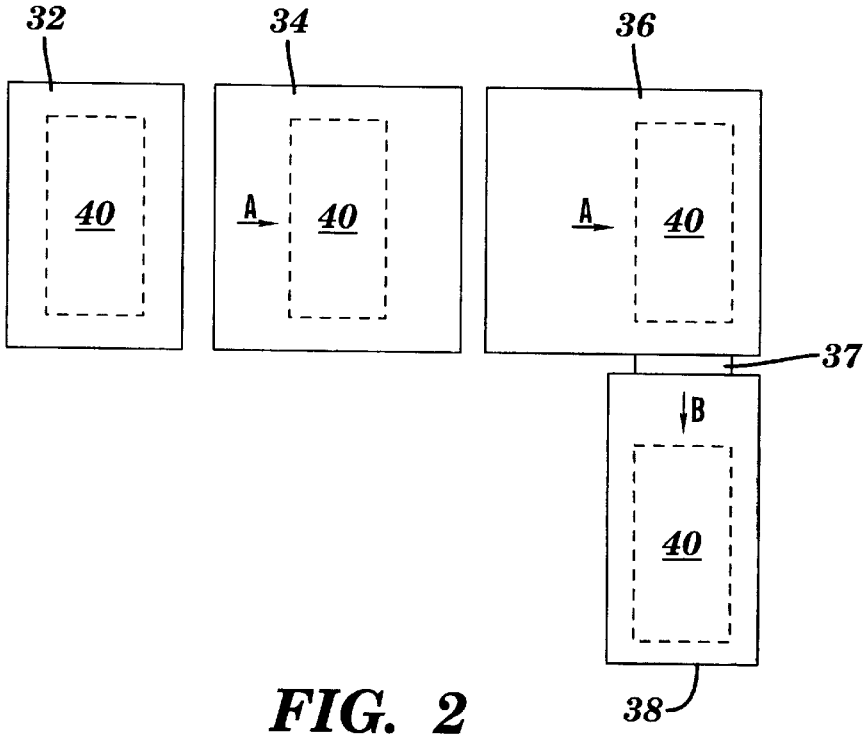
FIG. 2 shows an illustrative functional diagram of a plate bridge handler of the invention in a plate production system.

As shown in FIG. 2, an imaging system of an embodiment of the invention includes a plate storage device and feed handler 32, an image recording device or imaging engine 34, a plate bridge handler 36, and a plate processor 38. A plate 40 (shown in dashed lines) may be transferred from the plate feed handler 32, through the imaging engine 34, and into the plate bridge handler 36 along a first direction (generally indicated at "A"). The plate may then be output from the plate bridge handler 36 along a second direction (generally indicated at "B") to the plate processor 38 and then output from the plate processor 38 to a plate storage area or plate stacker 39. The second direction is generally perpendicular to the first direction in the present embodiment.

Each plate 40 may be passed from one unit to the next through input and output apertures in adjacent units, and the units (32, 34, 36 and 38) may abut one another to facilitate the prevention of light from contacting the plates prior to processing the plate image. The units may also be entirely enclosed within a larger housing.

In various embodiments of the bridge handler 36, the plate processor 38 may be replaced by, or as will be detailed below, used in combination with, any of a variety of different plate processing units. For example, automated or on-line plate processing devices such as a photo-chemical plate processor, a photo-polymer plate processor, a mechanical plate processor, a plate rinse/gum unit, a plate stacker, a plate baking oven, a plate punching or notching device, a plate bending device, or any other plate processor or storage unit, may used in combination with the bridge handler 36. Also, plates that are transported by the bridge handler 36 may be imaged, not imaged, or partially imaged, when output from the imaging engine 34. In various further embodiments, the system may include a plurality of plate processing or transporting units, and one of the units may comprise another imaging engine.

Figure 3:
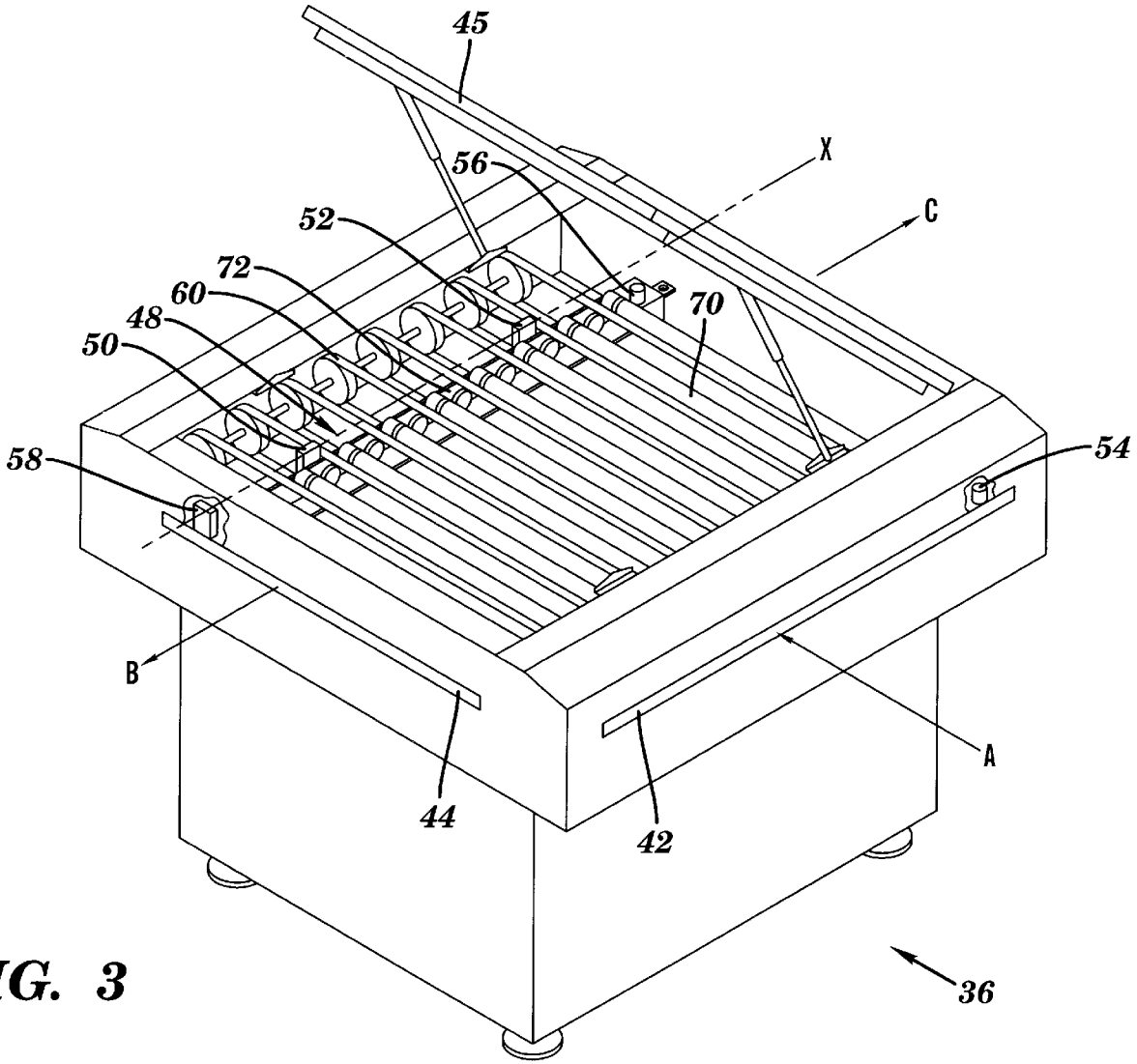
FIG. 3 shows an illustrative isometric view of the plate bridge handler of the invention engaged to receive a plate from a first direction and to distribute the plate in a second direction.

As shown in FIG. 3, in accordance with an embodiment of the invention, a plate bridge handler 36 may receive plates through an input aperture 42 along the direction generally indicated at "A", and may output plates via an output aperture 44 in the direction generally indicated at "B". Alternately, a plate may be received through the input aperture 42 along the direction generally indicated at "A", and may be output via another output aperture, not shown, in the direction generally indicated at "C". As further shown in FIG. 3, through the open top cover 45, the plate bridge handler 36 includes a multidirectional conveyor assembly that is indicated generally by reference numeral 48. The plate bridge handler 36 may further include positioning stops 50 and 52 for stopping a plate at a position, which aligns the plate for exit through the output aperture 44 and which may substantially align the plate edge with an axis "X" formed by the stops 50 and 52. Alternately, a single stop 50 may be used. Moreover, an input position switch or sensor 54, an intermediate position switch or sensor 56, and an output position switch or sensor 58 may be provided for providing an electrical signal in response to an edge of a plate passing the sensor.

Figure 4:
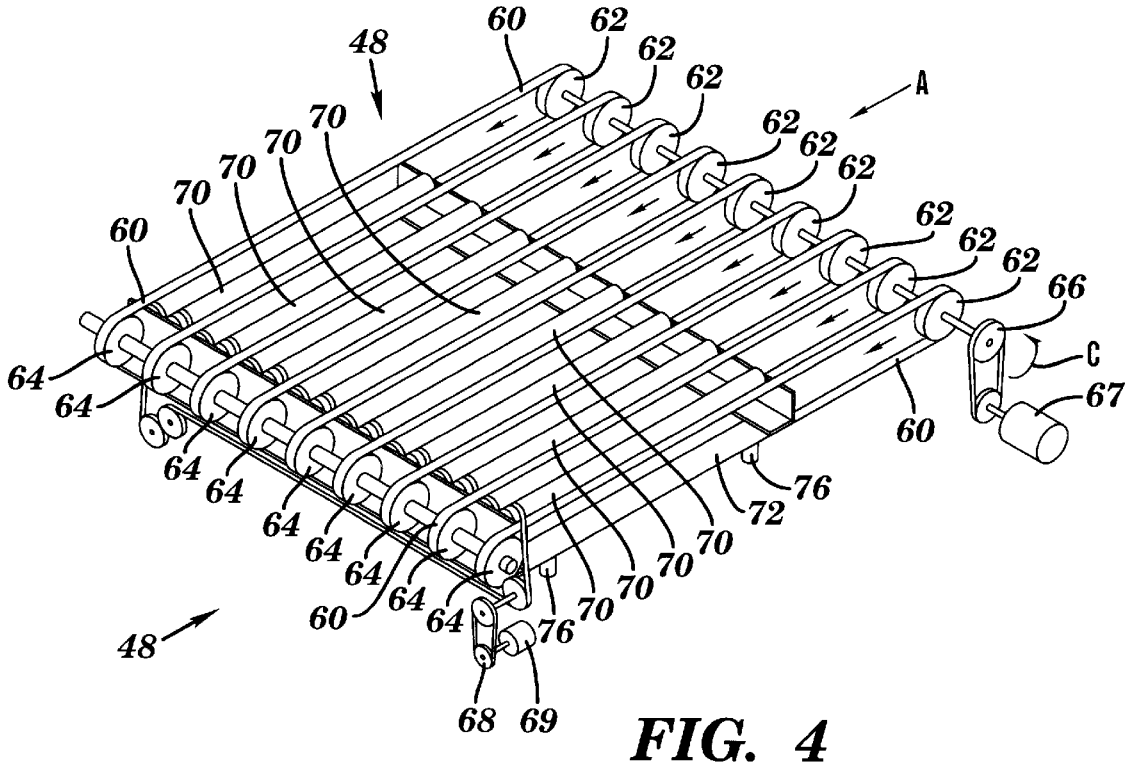
FIG. 4 shows an illustrative functional diagram of a portion of the plate transport device of the invention for transporting a plate in a first direction.
Figure 5:
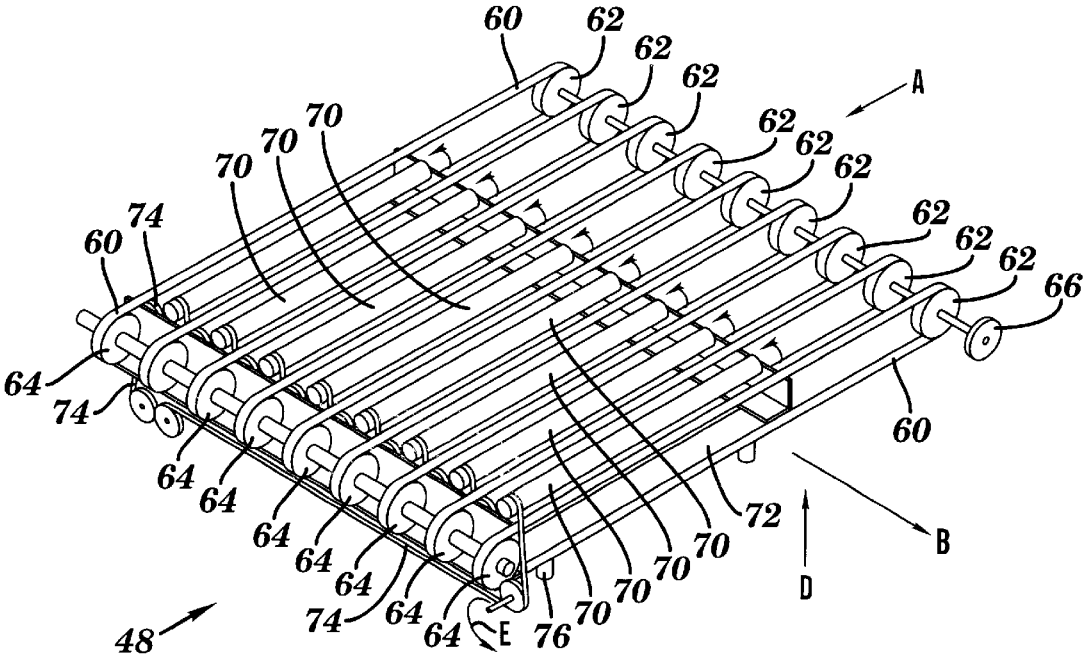
FIG. 5 shows an illustrative functional diagram of a portion of the plate transport device of the invention for transporting a plate in a second direction.

As further shown in FIGS. 4 and 5, the multidirectional conveyor assembly 48 includes a plurality of belts 60 wrapped around drive and follower pulleys 62 and 64 respectively. The drive pulleys 62 are driven by a belt drive pulley 66 that rotates in the rotational direction generally indicated at "C" in FIG. 4.

Figure 6:
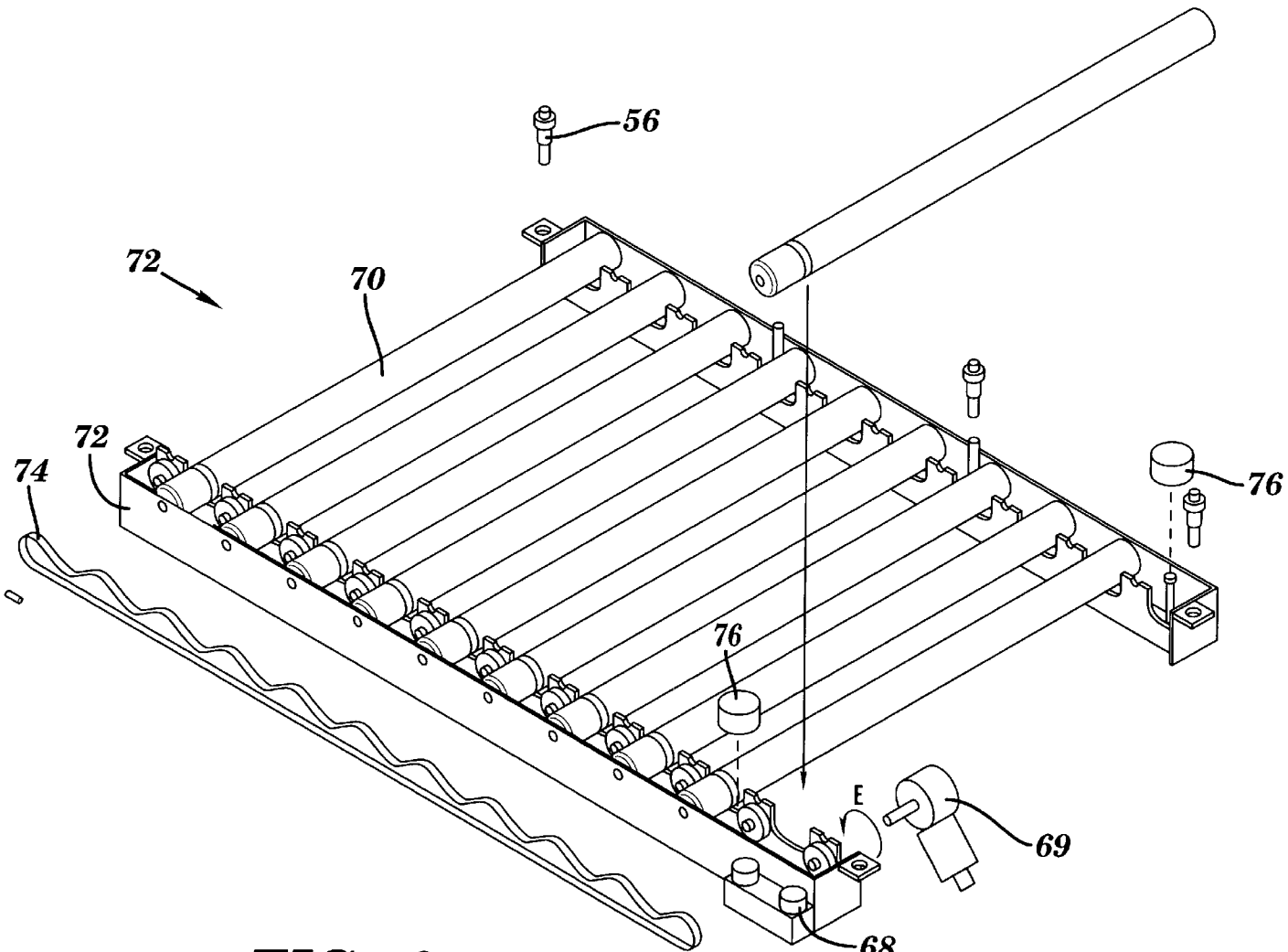
FIG. 6 shows an exploded functional diagram of a portion of the plate transport device of the invention for transporting a plate in a second direction.

The multidirectional conveyor assembly 48 also includes a plurality of rollers 70 (having a outer diameter of, for example, 50 mm) that are interposed between the belts 60, and each of the rollers 70 is mounted on a moveable frame 72. The rollers 70 may be rotated via movement of a serpentine belt 74 shown in FIG. 6. The belt 74 may be rotated via rotational actuation of the roller drive pulley 68 in either the direction generally indicated at "E", or in the direction that is rotationally opposite the direction generally indicated at "E" as discussed below in connection with further embodiments. The moveable frame 72 may be raised via actuation of pneumatic lifters 76 (e.g., four) in the direction generally indicated at "D" in FIG. 5.

During use, a plate enters the plate bridge handler 36 via the input aperture 42. The entering plate may initially be transported by an input transport device, e.g. within the imaging device 34 that is delivering the plate. Upon entering the input aperture 42, the input sensor 54 detects the presence of the plate leading edge and generates a plate input signal responsive to the detection of the leading edge. The plate input signal is communicated to a bridge handler electronic controller 200, which will be detailed below. The input sensor 54 may comprise a mechanical switch and actuator, which is actuated by the passing of the entering leading edge of the plate, or, the sensor 54 may comprise an optical emitter and detector which is actuated by the entering leading edge blocking the emitter radiation.

The input electrical signal causes the controller 200 to rotate a belt drive motor 67 which rotates the belt drive pulleys 66, which in turn causes the belts 60 to move along the top thereof in the direction generally indicated at "A". The moving belts 60, provide a friction force between a bottom surface of the entering printing plate 40 and the moving belts 60. The friction force serves to transport the plate 40 at substantially the same speed as the belts. One aspect of the invention is that the speed of the belts 60 do not need to match the speed of movement of the plate 40 as it enters the bridge handler 36 from another device. Moreover, the speed of the transport roller 70 also do not need to match the speed of movement of the plate 40 as it exits the bridge handler 36 to another device such as a plate processor.

Because the belts 60 or the rollers 70 only transport the plate 40 by friction against the bottom of the plate 40 the belts 60 or rollers 70 can slip if the plate speed is controlled by another device.

Once the plate is free of the input transport device the plate 40 travels along the belts 60 in the direction generally indicated at "A", at the speed of the belts 60, until it contacts the positioning stops 50, 52. The stops 50, 52 are mounted to the movable frame 72. The plate leading edge may also trigger the intermediate sensor 56, which generates an stop signal, which is communicated to the electronic controller 200 to indicate that the plate 40 has reached the position stops 50, 52. In order to align the plate edge with the stops 50, 52, such that the plate edge contacts both stops, the belt motor 67 may continue to be driven for some period after the stop signal is received by the electronic controller 200. This causes the belts 60 to continue to drive the plate 40 in the direction indicated by "A" thereby slightly rotating the plate 40, if required, until the plate edge contacts both of the positioning stops 50 and 52. The position stops 50, 52 form a plate edge alignment axis generally indicated by "X" in FIG. 3.

Once the plate edge is aligned with the axis "X" and the belts 60 are stopped. The electronic controller 200 causes the pneumatic lifters 76 to raise the moveable frame 72 upward (e.g., 20 mm). This causes the rollers 70 to be raised above the belts 60 thereby lifting the plate 40 off of the belts 60 so that the plate 40 is fully supported by the rollers 70 and free of the belts 60. The controller 200 then signals a transport roller drive motor 69 to rotate, thereby rotating roller drive pulley 68 in the direction indicated by "E". When the plate 40 has completely exited the bridge handler 36, the output sensor 58 is triggered. This sends a signal to the electronic controller 200 which causes the roller drive motor 69 to stop, and causes the pneumatic lifters 76 to permit the moveable frame 72 to be returned to its original position. The bridge handler 36 is then ready to receive a new plate.

Plate Buffer

The bridge handler 36 may receive printing plates 40 through the entrance aperture 42 at a first speed and delivers printing plates 40 through the exit aperture 44 at a second speed. Accordingly, the linear transport speed of the belts 60 may be set to substantially match a speed at which printing plates are received through the entrance aperture 42. Additionally, the rotational speed of the transport rollers 70 may be set to substantially match a speed at which the plates will exit through the exit aperture 44 once the next device accepts the plate 40. However, as pointed out above, because the belts 60 and rollers 70 allow slipping with respect to the bottom surface of the plate 40 the bridge handler 36 may receive a plate from and deliver a plate to devices which are operating at multiple speeds.

Accordingly, when a recording device 34 is operating at a first speed, a plate 40 is delivered through the input aperture 42 at the first speed by the recording device. The input sensor 54 senses the plate 40 and initiates the movement of the belts 60. The belts 60 may move at a plate transport speed which is faster, slower or the same speed as the first speed but will not actually transport the plate 40 until it is free from the imaging device 34. Once the plate is free from the imaging device 34 the belts 60 transport the plate 40 to the stops 50, 52 at the speed of the belts 60. As soon as the trailing edge of the plate 40 exits the recording device 34 it is free to begin recording the next plate. The rollers 70 may then transport the plate 40 to the exit aperture 44. A next device, e.g. the plate processor 38, is positioned to receive the plate 40 as it exits the bridge handler 36 and the next device may operate at a second speed, which is faster or slower than the first speed. Once the next device receives the plate 40, the next device transports the plate at the second speed until it exits the bridge handler 36. When the output sensor 58 detects that the plate trailing edge has exited the plate handler 36 the bridge handler 36 is free to accept another plate 40.

Figure 1:
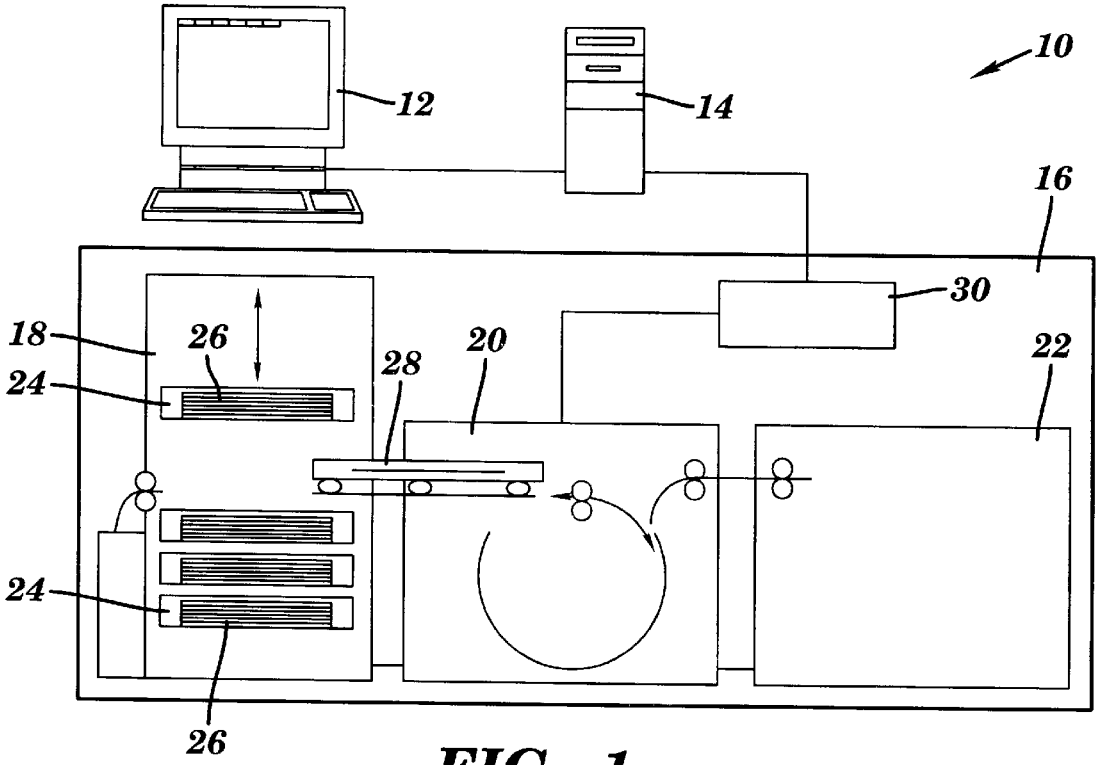
FIG. 1 PRIOR ART
FIG. 1 shows an illustrative view of one example of a prior art plate production system in which a plate handling system and recording device of the invention may be used.

According to the above description, the plate handler 36 may also serve as a plate buffer. The plate buffer receives plates from the recording device 34 at a first speed to free up the recording device to record a next plate while the bridge handler 36 feeds the plate 40 to a processing device 38 at a second slower speed. In a prior art embodiments, e.g. as shown in FIG. 1, the recording device 20 is directly attached to a plate processor 22. Accordingly, the recording device 20 can not record a next plate until the first plate is fully received by the plate processor 22. When the plate process 22 is operating at a slower speed than the recording device 20 a bottleneck in plate production results.

Electronic Control

Figure 7:
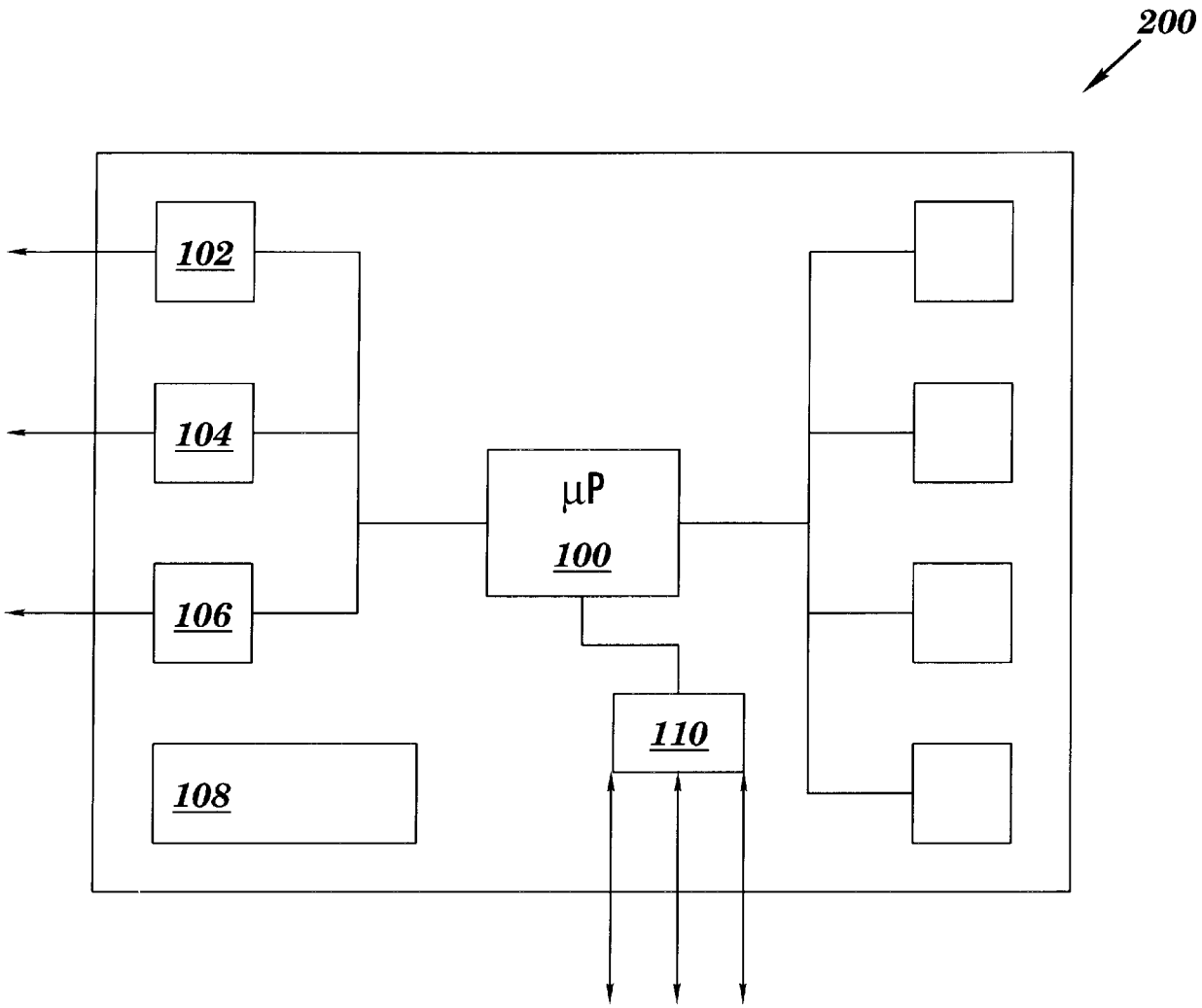
FIG. 7 shows a schematic functional diagram of a portion of an electronic controller used to control the bridge handler of the invention.

One embodiment of an electronic controller 200 according to the invention is shown in block form in FIG. 7. The controller 200 may include a micro-processor 100 which is interconnected with various other sub-modules for driving and controlling the electronic devices included with the handler 36. The modules may include a belt motor driver module 102, a transport roller driver module 104, a lifter module 106, a sensor module 108. The controller 200 may also include a power supply 108 to distribute electrical power to each of the electronic devices included within the bridge handler 36. According to one embodiment of the invention, the bridge handler 36 is a completely independent device. In this case, the bridge handler 36 senses the presence of an input plate by the input sensor 54 and initiates a series of operations within the electronic controller 200 to transport the plate through the bridge handler 36. For example, logic steps stored in the micro-processor or in another storage device respond to the input sensor signal by initiating a transport sequence which activates the various electronic device described above to transport a plate 40 through the bridge handler 36 and deliver the plate to a next device. Thereafter, the exit of the plate 40 to the next device is sensed by the output sensor 58 which initiates a series of operations within the electronic controller 200 to reset the bridge handler for receiving another plate. For example, logic steps respond to the output sensor signal by stopping the transport rollers 70 and lowering the lifters 76.

In other embodiments of the invention additional modules may be incorporated into the electronic controller 200. For example, a communication interface module 110 may be used to communicate with other devices. In one embodiment, the controller 200 may be in communication with a plate-input device, e.g. the recording device 34. In this case, logic steps stored within the controller 200 may signal the recorder 34 that the bridge handler 36 is unable to accept a next plate due to a plate still being in the bridge handler 36, or a plate jam or other malfunction.

In yet other embodiments of the invention the communication interface module 110 may be used to communicate with a plate-receiving device, e.g. the plate processor 38. In this case, a processor full signal may be received from the plate processor 38 indicating that it is unable to receive a next plate due to a plate still being in the processor 38, or a plate jam or other malfunction within the processor 38. In this case, logic steps stored within the controller 200 may stop the transport of the plate through the bridge handler 36. Upon receiving a second processor ready signal from the processor 38 the plate transport may be resumed. Also in response to the processor stop signal, the controller 200 may send a signal to the recording device 34 to indicate that it is unable to receive a next plate.

System Configuration

Figure 8:
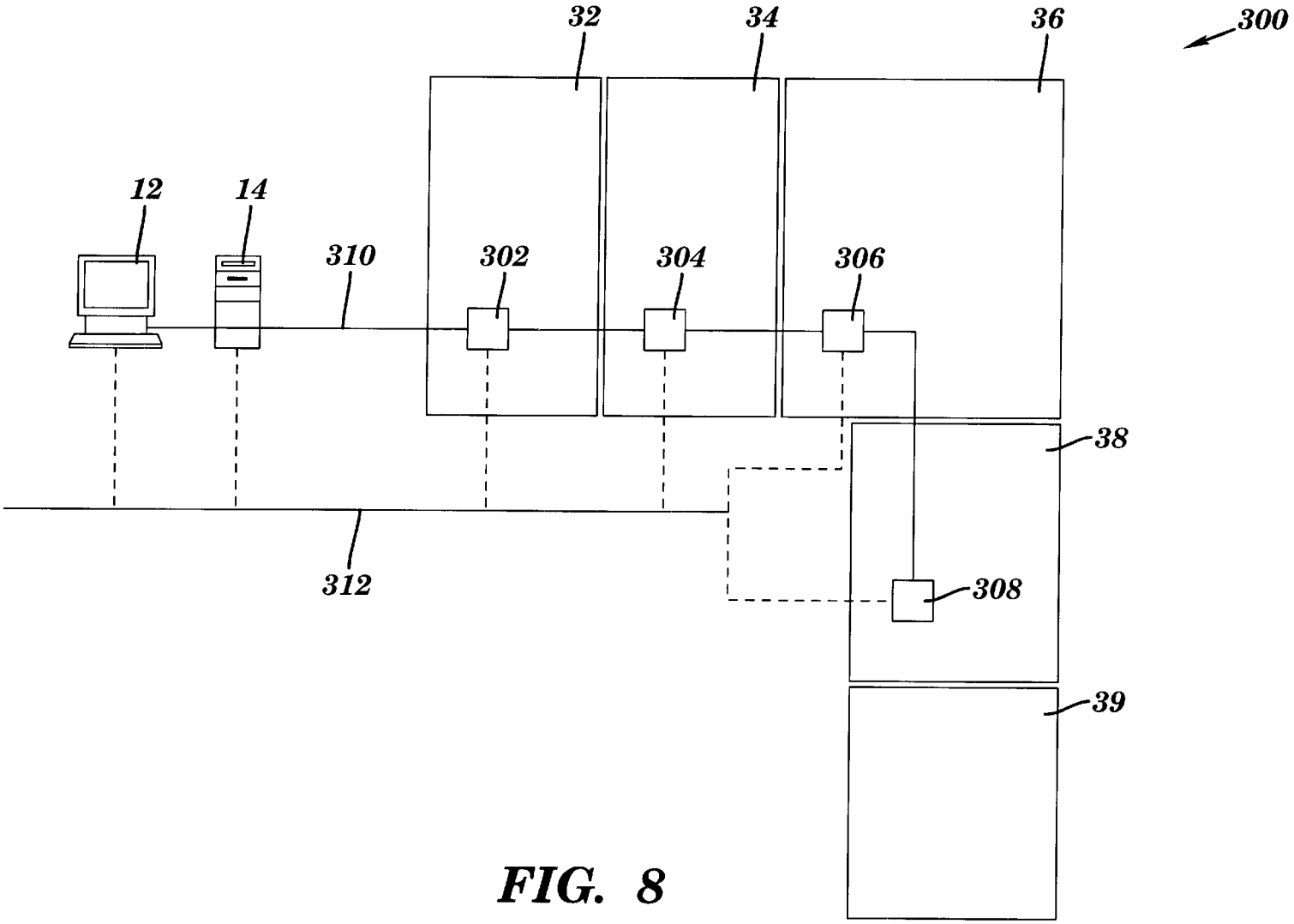
FIG. 8 shows an illustrative functional diagram of an embodiment of a plate bridge handler of the invention in a plate production system.

As further detailed in FIG. 8 the bridge handler 36 may form a portion of an overall plate production system 300. In this embodiment of the invention, the plate production system 300 may comprise a plate storage and feed handler 32, a plate recording device 34, a bridge handler 36, a plate processor 38 and a plate stacker 39. According to one embodiment of the system 300, each separate device includes an individual electronic controller 302, 304, 306, 308 for controlling the device operation. In addition, the system 300 may also include a front-end or server 12 and a raster image processor (RIP) 14 for sending electronic image files for recording onto the printing plates by the recording device 34.

According to one aspect of the invention each electronic controller may be interconnected serially to provide a one or two-way communication link 310 which starts at the front-end 12 and interconnects with each electronic controller in a chain to that last controller 308. Accordingly, a communication initiated in the front-end 12 may be passed to the RIP 14 and then relayed to the handler controller 302, on to the recording device controller 304 and so on until it reaches its intended destination. Conversely, a communication initiated in the plate processor controller 308 may be passed back through the chain of controllers 306, 304, and 302 to the RIP 14 and then to the front-end 12. In another embodiment, each device controller 302, 304, 306 and 308 may be directly connected to the front-end 12 such that the front-end 12 serves as a communication hub in two-way communication with each device. In yet another embodiment, each device controller 302, 304, 306 and 308 may be in communication with a network 312. In FIG. 8, a communication link between the network 312 and each device is shown as a dashed line. In this embodiment, a communication initiated at the front-end 12 may be sent over the network 312 directly to the appropriate device. Similarly, a communication initiated in a device could be sent via the network 312 directly to any other device or to the front-end 12.

It is also an embodiment of the invention that the bridge handler 34 may operate without communicating to any of the other devices in the system 300. In this case, the electronic controller 306, shown in FIG. 8, is not interconnected with another device controller or a network. In this case, the bridge handler 34 stores all of the needed program steps for transporting a printing plate received from a recording device 34 to a plate-processing device 38 within the electronic controller 304. The controller 304 may then respond to the signals received from the input, intermediate and output sensors, described above when a plate edge is detected by the sensors. The controller 304 then initiates the appropriate steps for transporting the plate without the need for communication with either the recording device 34, the processor 38 or the front-end 12.

According to the system configuration 300, shown in FIG. 8, an operator of the front-end 12 can have information displayed relating to any aspect of the entire system 300. Accordingly, the system 300 may also include control software for checking system status including the status of any of the system devices. The system 300 may therefore track such information as the number, type and size of plates remaining in the input handler 32, the job being recorded by the recording device 34, the operation status of the bridge handler 36, status or chemistry information from the plate processor 38 and other system related information. Accordingly, a further portion of plate production is automated by the present invention. The automation allows an operator of the front-end 12 to manage plate production, including plate recording, plate processing and plate stacking without the need to physically handle printing plates by hand or to physically go to each device to check the status of plates being prepared for a printing job.

Plate Orientation

It is common in a recording device 36 and on the printing press to wrap the short dimension of a printing plate around a circumferential axis of an internal or external drum cylindrical support surface during recording of or printing of an image. This wrap direction is recommended by plate manufacturers to prolong the plate run life for a print job. The desire to wrap the short dimension of a printing plate 40 around a circumferential axis results in plates exiting the recording device with the long dimension 41 generally perpendicular to the transport direction, indicated by "A", in FIG. 2. This was also true in the prior art systems, of which FIG. 1 one example. Accordingly, the bridge handler 36 will generally receive the plate 40 through the input aperture 42 by the long dimension 41.

In conflict with generally receiving the plate 40 through the bridge handler input aperture 42, by the long dimension 41, it is desirable to feed the plate 40 into a plate processor 38 by the plate narrow dimension 43. A narrower plate processor 38 costs less to manufacture and can process the same size plate using a smaller volume of chemistry. Accordingly a narrower plate processor 38 is more economical to operate. One aspect of the bridge handler 36 of the invention is that the plate 40 is redirected along a substantially perpendicular transport axis before entering the processor 38. This aspect of the bridge handler 36 enables the use of a narrower processor 38. The plate processor entrance aperture 37 need only be wide enough to receive and transport the narrow plate dimension 43. This is not the case in prior art systems, which advanced the plate to the plate processor by the wide dimension 41.

The bridge handler 36, of the invention, may be sized to accommodate printing plates in a range of sizes. Each printing plate 40 includes a wide dimension 41 and a narrow dimension 43, or, the wide and narrow dimensions may be equal. According to one embodiment of the bridge handler 36, very large printing plates may be transported. The very large plates 40 may range in size from about 1143×1448 mm, (45×75 in.) up to about 1473×2032 mm, (58×80 in.). For handling the very large plates, the input aperture 42 may have a dimension of greater than 2032 mm (80 in.) to receive the largest printing plate 40 by its long dimension 41. Accordingly, the output aperture 44 for handling very large plates may have a dimension of greater than 1473 mm (58 in.) to transport the largest printing plate 40 by the short dimension 43. Also, for handling very large plates, the transport system 48 must be sufficiently sized to transport the largest plate and align it for transport to the plate processor 38.

Very Large Format Plate Recording System

Figure 9:
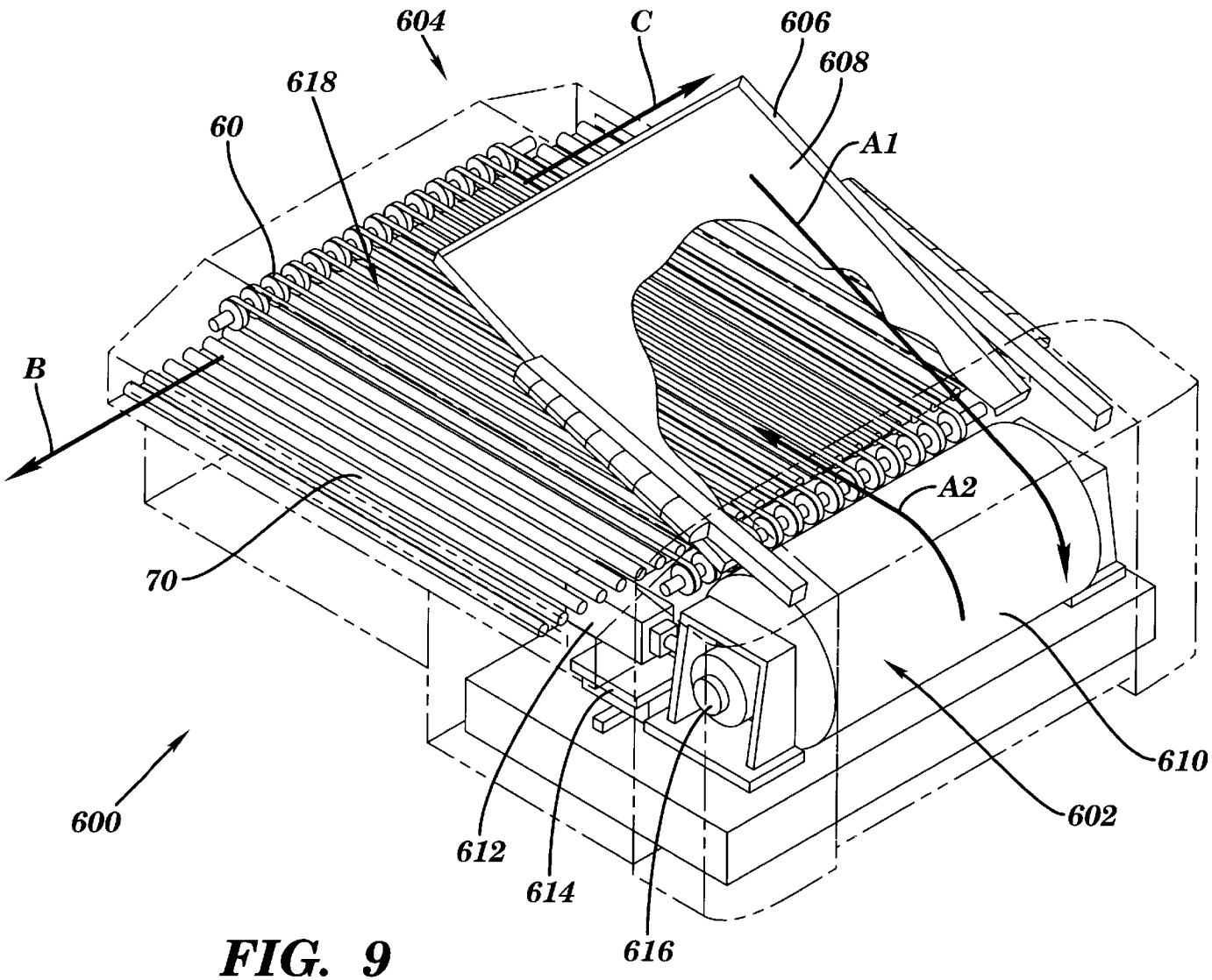
FIG. 9 shows an illustrative functional diagram of another embodiment of a plate bridge handler of the invention in a plate production system for producing very large plates.
Figure 10:
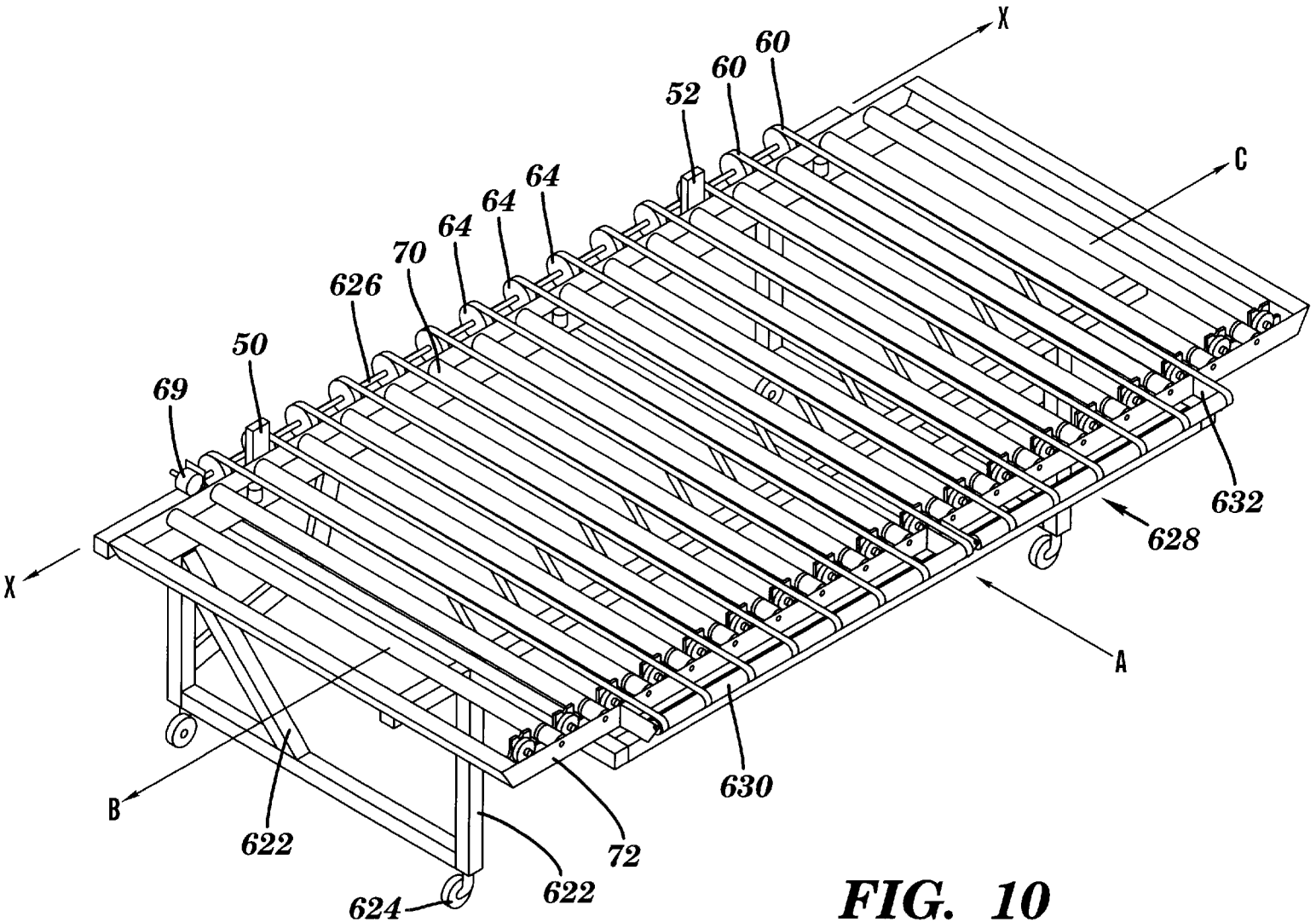
FIG. 10 shows an illustrative functional diagram of a further embodiment of a plate transport device of the invention for transporting very large plates.
Figure 11:
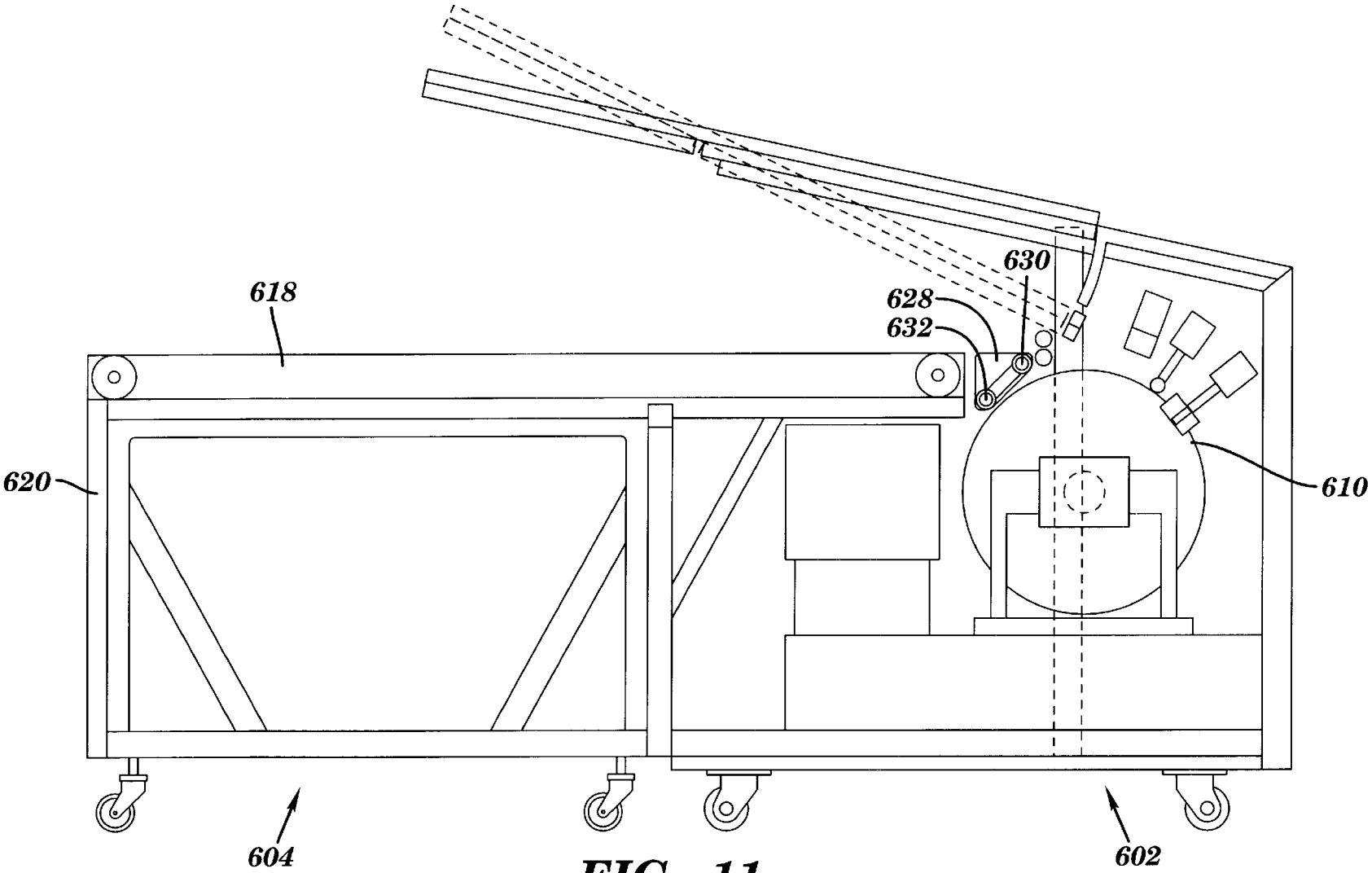
FIG. 11 shows an illustrative functional diagram of one embodiment of the bridge handler of the invention positioned to receive plates from an external drum recording device according to the invention.

One example of a very large format (FLV) plate recording system 600 is shown in FIGS. 9–11. The VLF system 600 includes a VLF recording device generally indicated by reference numeral 602 and bridge handler 604 according to the invention. A plate-input platform 606 is inclined at a convenient angle for receiving a very large format printing plate 608. An operator places the very large plate 608 onto the platform 606. Once the plate 608 is loaded onto the platform 606 the plate is automatically loaded onto an external surface of a recording drum cylinder 610 as shown by the arrow A1. The recording drum 610 is then rotated at a substantially constant rotational velocity while a recording head 612 records an image onto the plate 608. The recording head 612 includes a radiation source, (not shown) for providing an exposing beam. The exposing the beam is modulated according to an image information signal to record an image onto the plate 608 while it is mounted onto the recording drum cylinder 610 and rotating past the exposing beam. A carriage 614 transports the recording head 612 along an axis which is substantially parallel with a longitudinal axis 616 of the rotating cylinder 610. Once the recording is complete, the VLF plate 608 is advanced to the bridge handler 604 as shown by the arrow A2.

The bridge handler 604 includes a VLF plate transport device 618 which is similar to the plate transport device 48 disclosed above and for which like elements will be identified by the same reference numbers as were used above. The VLF plate transport device 618, best shown in FIG. 10, includes a plurality of belts 60 for transporting a plate entering as indicated by arrow "A" and for transporting the plate 602 to position stops 50, 52. Each of the belts 60 is wrapped about a belt drive pulley 64. Each belt drive pulley 64 is attached to a drive shaft 626, which is driven by a belt drive motor 69 to drive each belt 60. At the input end 628 of the plate transport device 618 each belts 60 are wrapped about an upper input roller 630 and a lower input roller 632 which each act as an idler pulley for the belts 60. The input end 628 is shown more clearly in FIG. 11, which shows the VLF system 600 in phantom side view. In this case the plate transport device 618 has an input end 628 which interfaces with the cylindrical drum 610 of the VLF recording device 602 to receive a plate 608 directly from the cylindrical drum surface. As shown in FIG. 11, the upper input rollers 630 are positioned adjacent to the drum 610 such that the belts 60 are generally horizontal and generally moving along an axis which is tangential to the cylinder 610 at the top thereof.

The VLF plate transport device 618 further includes transport rollers 70 supported on a movable frame 72. Once a plate is positioned with its leading edge generally parallel with the axis formed by the stops 50, 52, the movable frame 72 may be raised by lifters 76. The lifting of the transport rollers 72 supports the plate 602 independently of the belts 60 and the transport rollers 70 are rotated to transport the plate out of the VLF bridge handler 604. The plate 608 may be directed in either direction B or C according to the direction of rotation of the transport rollers 70. The transport rollers and roller drive system are described above and shown in FIG. 6.

Figure 10A:
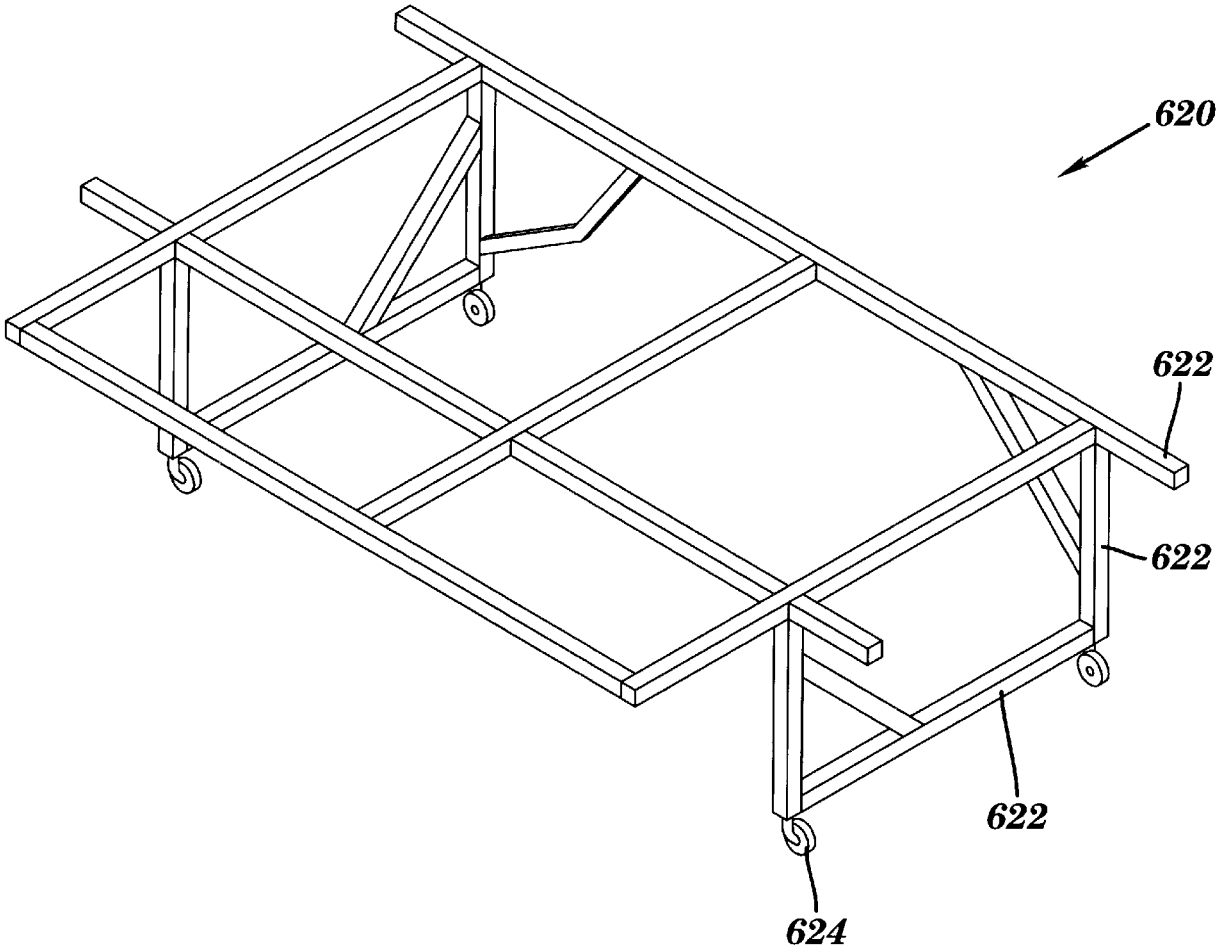
FIG. 10A shows an illustrative functional diagram of a support frame of the invention for supporting the plate transport device.

The VLF bridge handler 602 further includes a support frame 620 as shown in FIG. 10A. The frame 620 includes a plurality of support members 622 supported on wheels 624 for conveniently moving the bridge handler 604 away from the VLF recorder 602 for servicing either device. As shown in FIG. 11, the frame 620 supports the VLF transport device 618 such that the input end 628 is positioned over a portion of the recording device 602 to receive a plate 608 directly from the drum cylinder 610.

Figure 12:
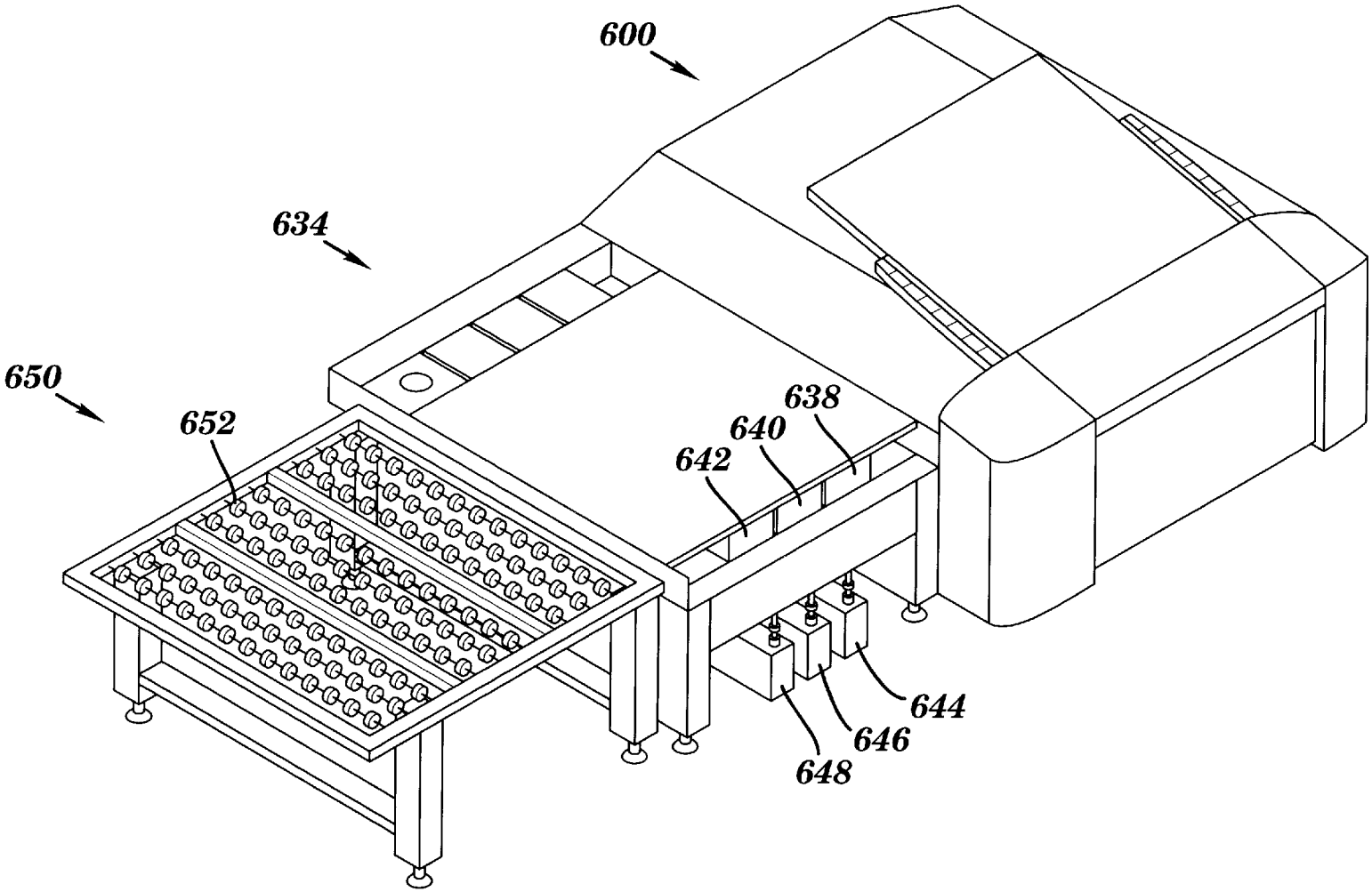
FIG. 12 shows an illustrative functional diagram of one embodiment of a plate production system for producing very large plates according to the invention.

In FIG. 12, the VLF recording system 600 is shown with light tight covers 620 installed over the entire system. A plate chemical processor 634 is shown attached to the VLF recording system 600 for receiving imaged plates from the VLF bridge handler 604. The processor 634 is shown with the covers removed for illustrative clarity. The processor 634 includes processor transport rollers 636 for transporting the VLF plate 608 through chemical baths. The various chemical baths may develop the image recorded onto the plate, further fix the image onto the plate, and may also wash the plate before it exits from the processor 632. In the present embodiment, three bath sections 638, 640 and 642 are connected together with three chemical supply jugs 644, 646 and 648. A pump and waste disposal system, not show, refresh each bath with fresh chemistry as required. After processing, the VLF plate 608 is transported by the processor transport rollers 636 onto a stacker 650 where a plurality of imaged plates may be stored until collected by an operator. The stacker 650 may comprise a table with rolling elements 652 installed thereon for receiving a plate thereon or the stacker 650 may be an automated device for stacking plates in a particular fashion such as on a plate pallet or the like.

Plate production system

In other embodiments of the present invention the bridge handler 36 of the invention may be used in a plate production system in combination with an internal drum-recording device. A plate production system 700 is partially shown in FIG. 13. The system 700 includes the bridge handler 36 which is described in detail above and shown in FIG. 3, an internal drum image recording device 704 and a plate processing device 702. In the plate production system, the internal drum recorder 704 receives a plate 706 by the wide dimension 708, from an automatic plate delivery system such as the device 18 shown in FIG. 1. The plate delivery system may deliver printing plates 706 in a range of plate sizes, thickness' or plate types. One such automatic plate delivery system is detailed in U.S. Pat. No. 5,738,014, the disclosure of which is hereby incorporated by reference.

Figure 13:
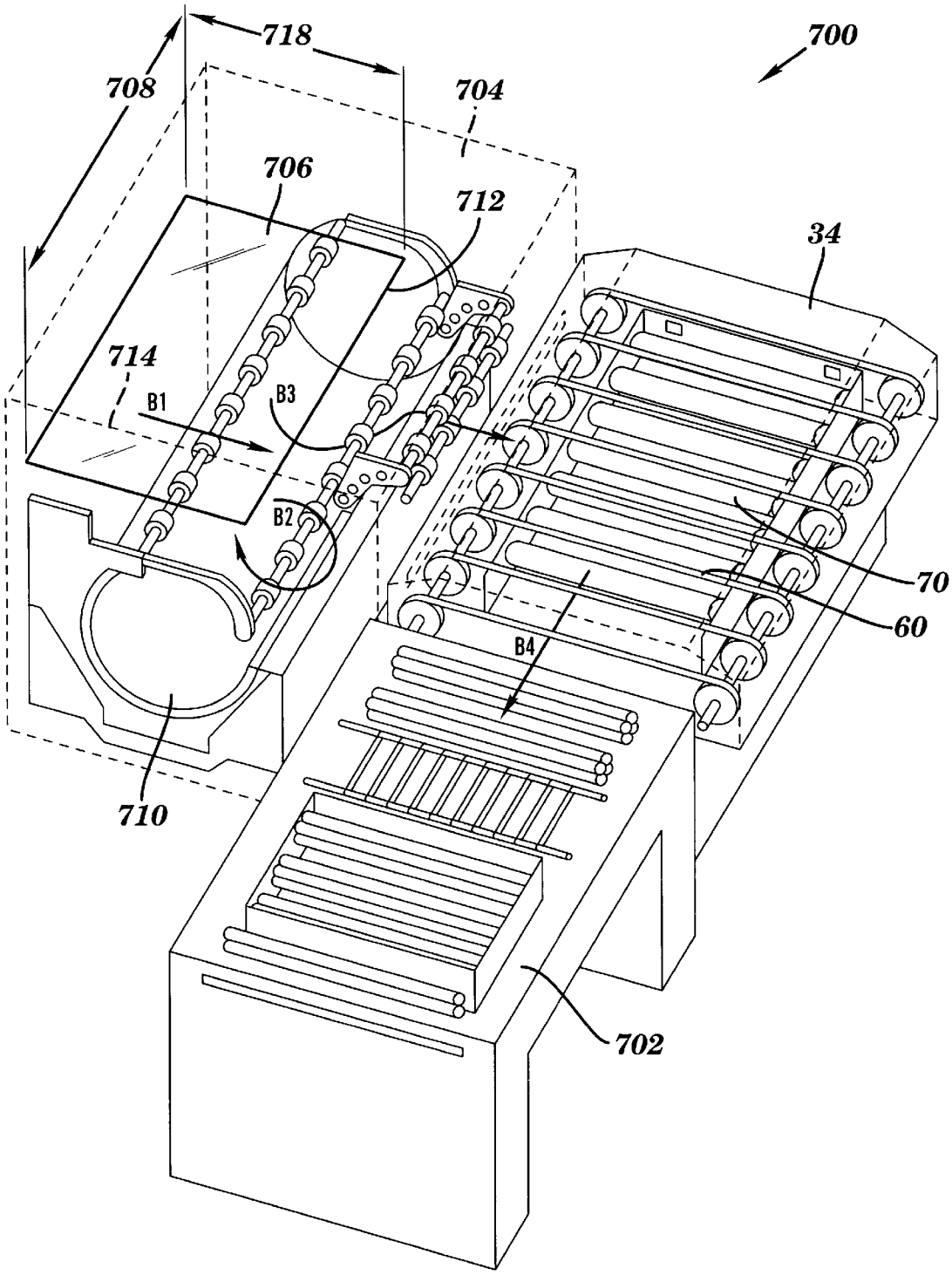
FIG. 13 shows an illustrative functional diagram of one embodiment of the bridge handler of the invention positioned to receive plates from an internal drum recording device according to the invention.

As shown in FIG. 13, a plate 706 enters the internal drum recording device 704 from the direction of the arrow labeled "B1" and is mounted onto an internal drum cylindrical surface 710. The plate 706 has a leading edge 712 and a trailing edge 714 shown in FIG. 13 as it enters the internal drum image recording device 704. During loading of the plate 706, the plate leading edge 712 is guided onto the drum cylindrical surface 710 in the direction indicated by the arrow labeled "B2". After image recording, the plate 706 exits the internal drum recording device 704 by the trailing edge 714 first. The arrow labeled "B3" shows this. Accordingly, the plate trailing edge 714 becomes the plate leading edge as the plate enters the bridge handler 36. Upon entering the bridge handler 36, the plate 706 advances to the stops 50, 52 and is then advanced out to the plate processor 702 along the direction of the arrow labeled "B4".

One example of the plate production system 700 may be sized to receive plates 706 that range in size from about 450×368 mm, (17.72×14.5 in.) up to about 1130×820 mm, (44.5×32.29 in.). For this range of plates sizes the bridge handler input aperture 42 may have a dimension of greater than 1130 mm (44.5 in.), to receive the largest printing plate in the above-listed range of sizes, by the plate long dimension 708. Accordingly, the bridge handler output aperture 44 may have a dimension which is greater than 820 mm, (32.29 in.), to transport the largest printing plate in the above-listed range of sizes by a short dimension 718. Accordingly, the present invention may be designed to handler larger or smaller plate sizes by varying the length of the belts 60 and the rollers 70 according to a range of plate sizes to be handled.

Multiple Output Units

Figure 14:
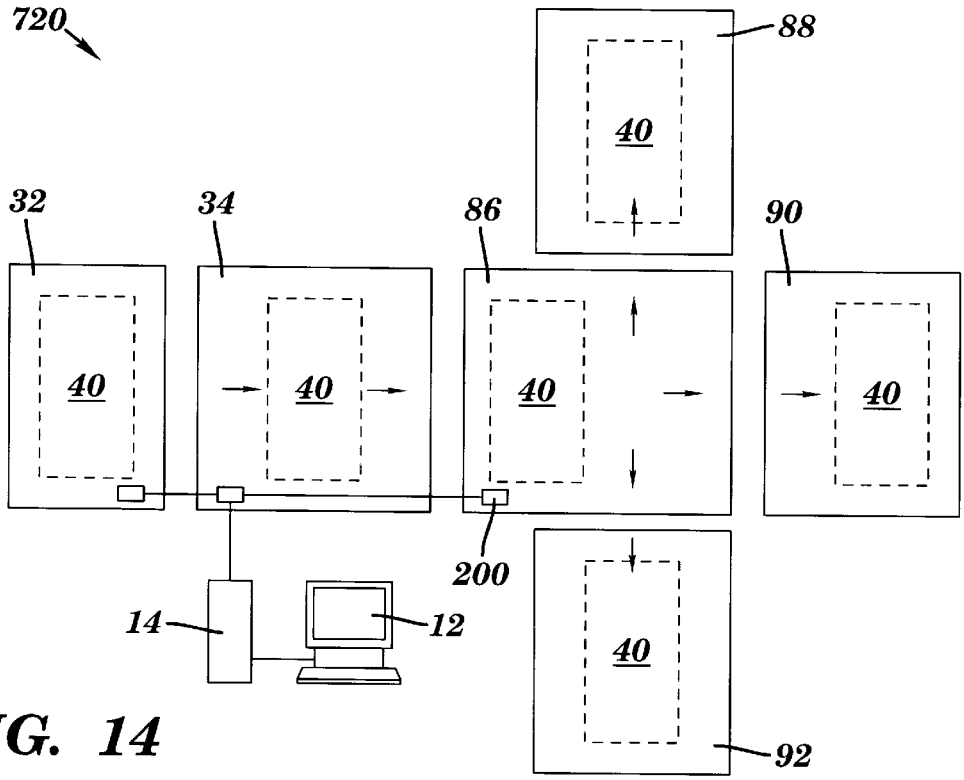
FIG. 14 shows an illustrative functional diagram of a plate bridge handler of the invention in another embodiment of a plate production system.

Referring now to FIG. 14, a plate production system 720 employs a plate bridge handler 86 of a further embodiment of the invention together with a plurality of output units 88, 90 and 92. During operation, each plate 40 may be diverted to any one of the output units (88, 90, 92). The bridge handler 86 is similar to the bridge handler 36, except that the positioning stops 50, 52 may be optionally retractable so that a plate 40 may be transported directly through the plate handler 86, e.g. by the belts 60, to the output unit 90. The bridge handler 86, under control of an electronic controller, may also optionally transport the plate 40 to either the output unit 88 or the output unit 92 by rotating the transport rollers 70 in an appropriate direction. Again, the output units (88, 90, 92) may comprise any of a wide variety of output devices such as a variety of chemical and mechanical plate processing devices.

For example, the system 720 may include more than one plate type stored within the input handler 32 and each plate type may require a different plate processor. In one embodiment of the system 720, output unit 88 comprises a plate chemical processor for processing one particular type of printing plate stored in the input handler 32 and the output unit 92 comprises a plate chemical processor for processing a different type of printing plate stored in the input handler 32. In addition, the output unit 90 may comprise a plate storage device or stacker for storing plates which either do not require any processing or which require processing other than what is available by the output units 88 and 92. Alternately, the output unit 90 may comprise a third chemical plate processor for processing yet a different type of printing plate stored in the input handler 32.

According to the invention, as detailed in FIGS. 7 and 8, the system 720 may also include a front-end 12 and a RIP 14 which at least communicate image recording data and plate type selection data information to the recording device 34 and the input handler 32. According to the invention, the plate selection type is communicated to the bridge handler electronic controller 200. The electronic controller 200 may then used program steps stored therein to direct the plate to an appropriate output unit 88, 90 or 92.

Figure 15:
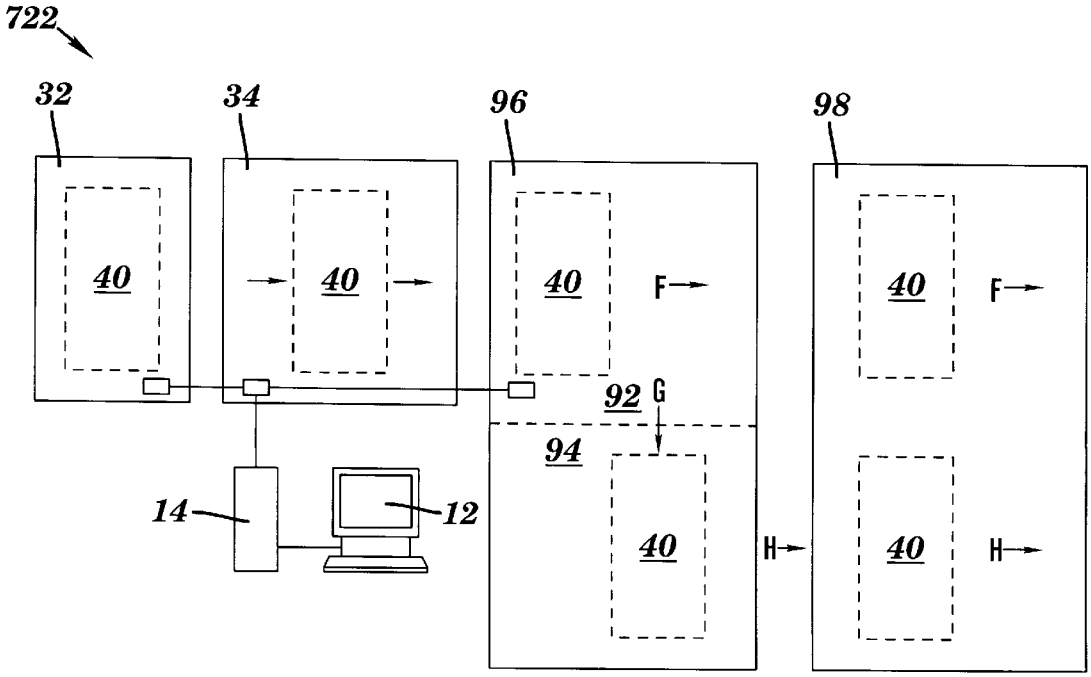
FIG. 15 shows an illustrative functional diagram of a plate bridge handler of the invention in yet another embodiment of a plate production system.

As shown in FIG. 15, a plate production system 722 includes a plate bridge handler 96 of a further embodiment of the invention which includes two plate transport devices (92,94) of similar construction to the plate transport device 48 detailed in FIGS. 3–6. The first plate transport device 92 may transport a plate 40 along a direction generally indicated at "F" via belts 60 and pulleys 62, 64 as disclosed above. Alternately, the first transport device 92 may transport the plate 40 along a second direction generally indicated at "G" via the transport rollers 70 mounted on the moveable frame 72 that may be lifted by pneumatic lifters 76 as also discussed above. According to the invention, the second plate transport device 94 is rotated 90 degrees with respect to the first plate transport device 96 such that a plate 40 is received from the first plate transport device 96 onto belts 60 of the second transport device 96. The second plate transport device 94 may transport the plate 40 along a second direction generally indicated at "H" via the transport rollers 70 mounted on the moveable frame 72 that may be lifted by pneumatic lifters 76 as also discussed above. In the case of the bridge handler 96, a single electronic controller 200 may control each of the plate transport devices 92, 94. Position sensors similar to those discussed above may also be employed to sense the plate position and provide signals to the electronic controller 200.

The output unit 98 of the plate production system 722 may comprise two parallel processing chemical baths along the directions generally indicated at "F" and "H". The baths may provide for efficient use of processing chemicals yet permit plates of various sizes to be readily processed during in-line image processing. The directions F and H may also direct the plates to further diverging processing steps e.g. each path may further process a plate for mounting onto a different printing press which may require different bending punching or notching steps.

Figure 16:
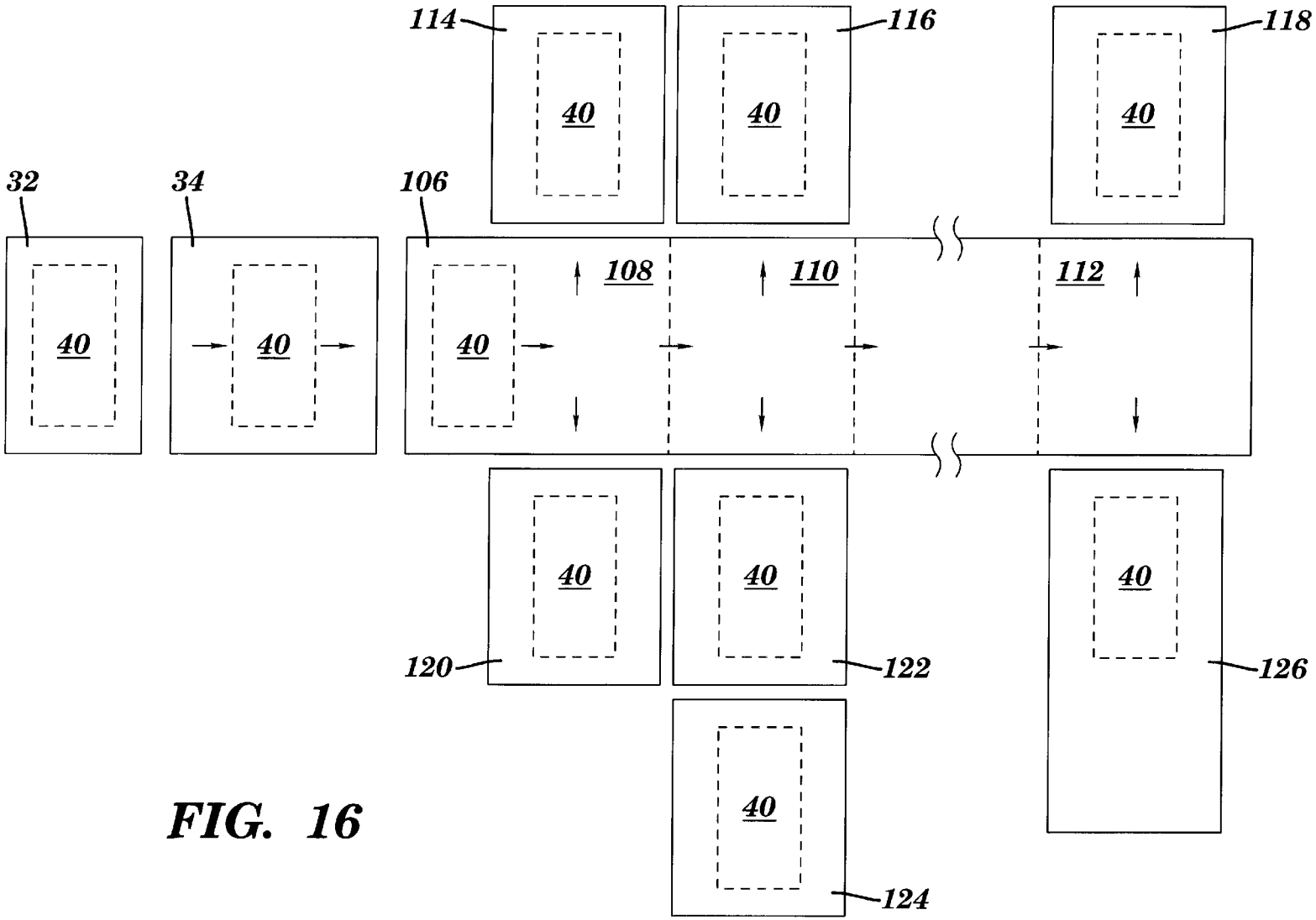
FIG. 16 shows an illustrative functional diagram of a plate bridge handler of the invention in still another embodiment of a plate production system.

As shown in FIG. 16, a plate bridge handler 106 of a further embodiment of the invention may be used with a large number of output units. In particular, the handler 106 may include a plurality of plate transport devices 108, 110 and 112 placed in series or, a unitary plate transport device may service the entire longitudinal length of the handler 106. In the first case, each of the plate transport devices 108, 110 and 112 may be substantially similar to the transport device 86 described above in that a plate entering the device may be transported in any one of three directions. So, e.g. in the first device 108, the plate 40 may be distributed to the output units 114 or 120, or, the plate 40 may be transported to the next plate transport device 110. Accordingly, each transport device in the series may be operated in the same manner.

Figure 17:
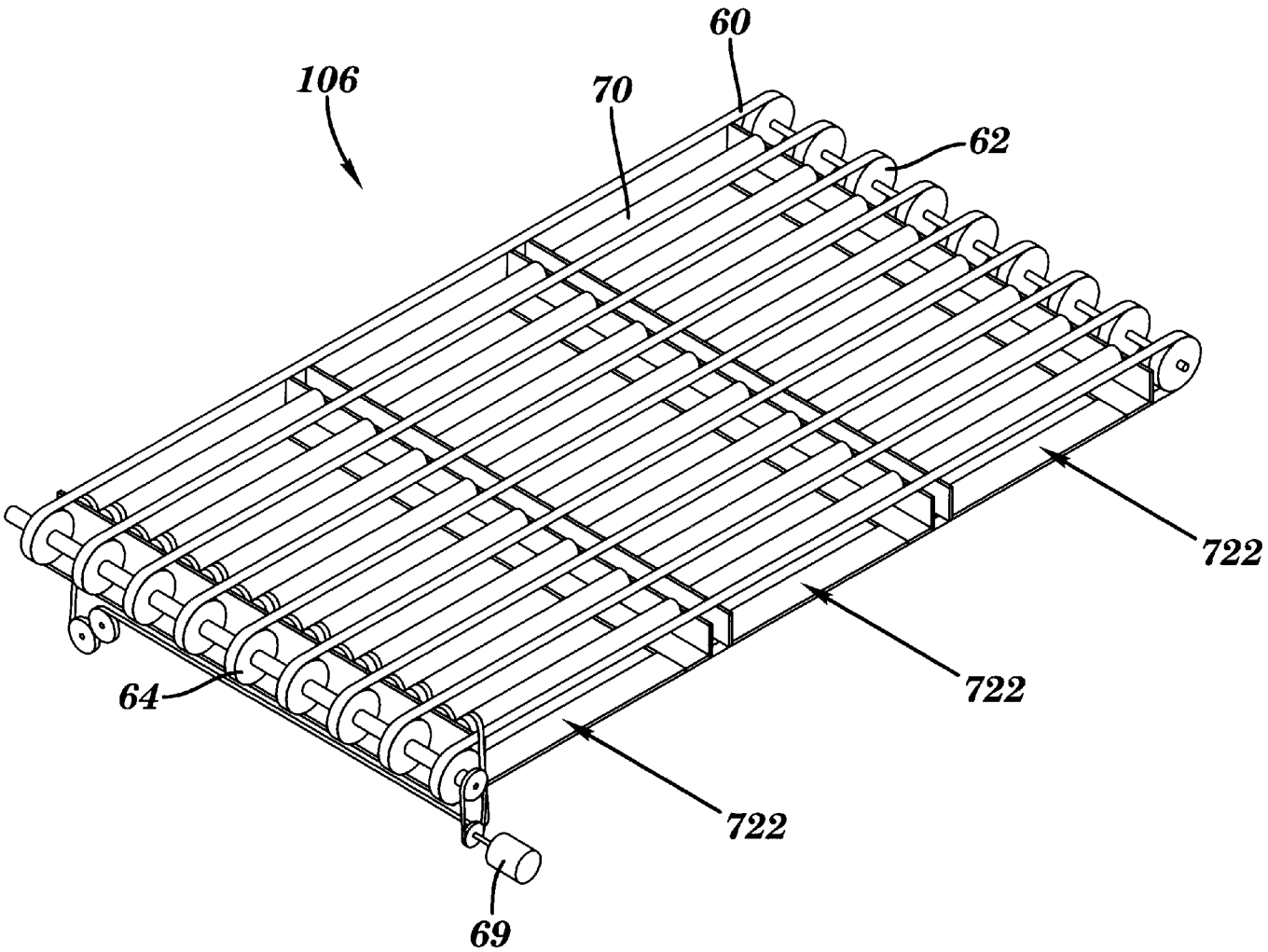
FIG. 17 shows an illustrative functional diagram of yet another embodiment of a plate bridge handler of the invention for distributing plates to multiple output units.

A second embodiment of the transport device 106 is shown in detail in FIG. 17. In this case a plurality of belts 60 are supported on pulleys 62 and 64 which are mounted at distal end of the plate transport 106 so as to carry a single plate over the full length of the plate transport device 106. To move the plate transversely to the belts 60, three movably supported roller transport devices 722 are interposed between the belts 60. One embodiment of a roller transport device is described above and shown in detail in FIG. 6.

The plate transport device 106 also includes an electronic controller 200, shown in FIG. 7, however, additional drivers and program steps may be added to control the transport device 106. The movement of a plate 40, by the belts 60, may be stopped at any one of the three transport devices 722 by providing a sensor associated with each roller transport device 722. The sensor senses the leading edge of the plate 40 as the leading edge reaches a transverse transport position as provided by a roller transport device 722 and sends a signal to the electronic controller 200 to stop the movement of the belts 60. The pneumatic lifters 76 then raise the roller transport device 722, over which the plate 40 is stopped. The plate 40 is then transported to one of the output units e.g. 114 or 120.

The handler 106 may be used to direct a plate to any of the various output units 114–126. Position sensors may be used as discussed above to monitor the position of the plates as they move through the handler 106, and to trigger the appropriate actuators for controlling plate movement. The output units 114–126 may include any of the above described output units, as well as serially arranged processing devices (e.g., 122, 124) such as an output device and an output table or for example a plate punching device and a plate bending device.

Figure 18:
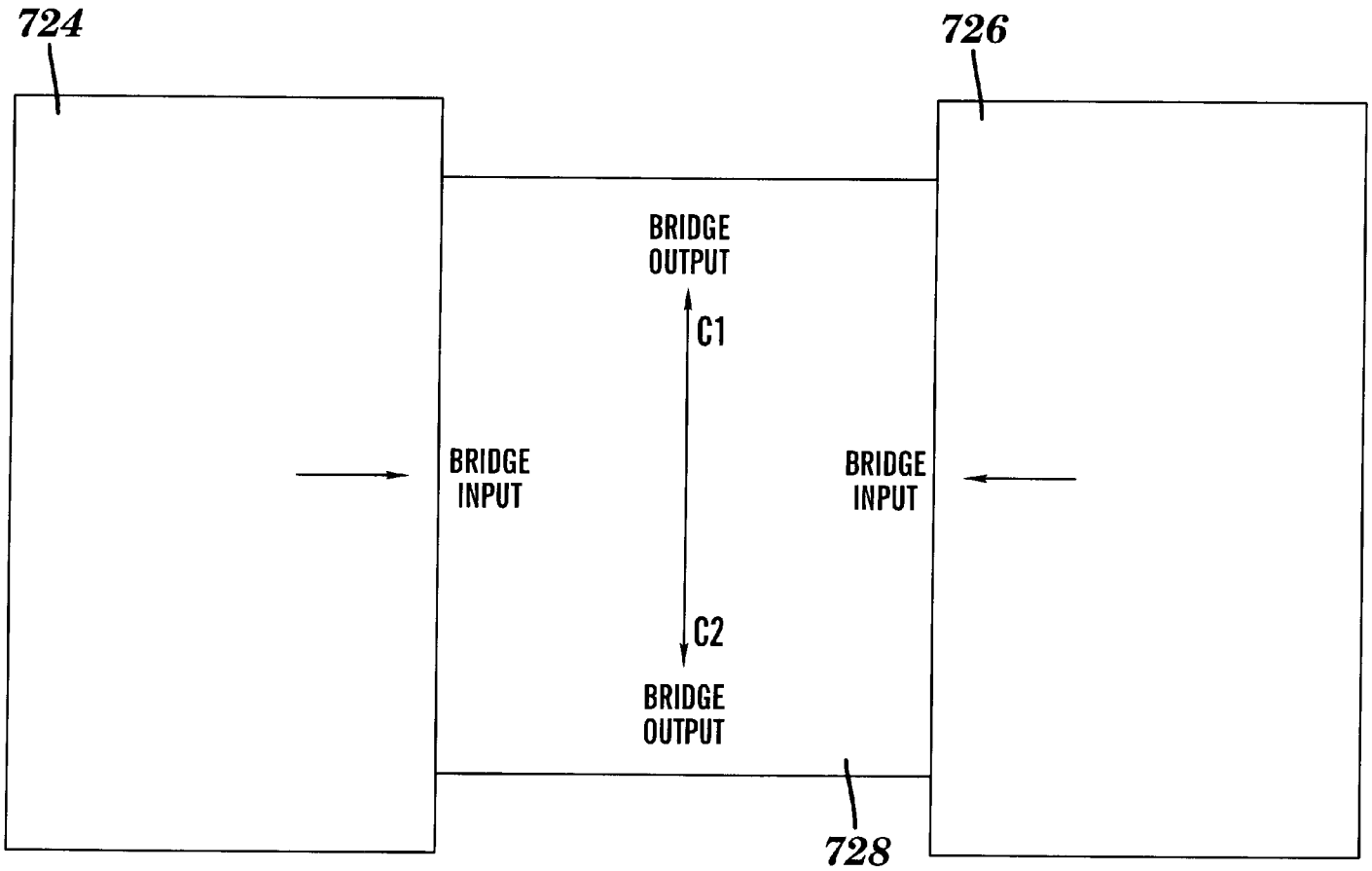
FIG. 18 shows an illustrative functional diagram of one embodiment of a plate bridge handler of the invention for receiving plates from two recording devices.

In various further embodiments, more than one image recording device may feed plates to a single plate bridge handler of the invention. One such embodiment is shown in FIG. 18 wherein a first image recording device 724 and a second image recording device 726 are each connected with a bridge handler 728 configured to receive plates from one or the other recording device 724, 726 by providing two input apertures and by rotating the transport belts 60 in opposite directions to receive a plate from each of the recording devices 724, 726. The bridge handler 728 having received a plate from either recording device may then transport the plate in a direction indicated by the arrows labeled "C1" or "C2".

Position Stop Embodiments

In the embodiment detailed above, and shown in FIGS. 3 and 10, the position stops 50, 52 provide a hard mechanical stop mounted in a fixed relationship with respect to the movable frame 74. In addition, the intermediate sensor 56 provides a signal to the electronic controller 200 indicating that the plate edge has reached the position of the intermediate sensor. In order to move the plate edge is against both of the stops 50, 52, the belt drive motor 67 may continue to be driven for a short time after the intermediate sensor signal is received.

In other embodiments of the invention, the stops 50, 52 may be manually or automatically movable along the "X" axis, in order to adjust the position and or separation of the stops to accommodate various plate sizes and various positions of an entering plate. The stops 50, 52 may also manually or automatically movable along an axis generally perpendicular to the "X" axis. This allows adjustment of the location of the stop position with respect to the exit aperture 44, so that plates may be center, left or right justified with respect to the bridge handle exit aperture 44. The stops 50, 52 may also be manually or automatically retractable. By retracting the positions stops 50, 52, a plate may continue to be transported by the belts 60 so that the plate exits the bridge handler through an exit aperture provided opposed to the bridge handler input aperture 42. See e.g. the embodiments of FIGS. 14 and 16.

In another embodiment of the invention, the stops 50, 52 may replaced by elements that provide one or more electrical signals in response to the detection of a plate edge. For example, one or more intermediate sensors 56 may be used instead of hard stops. The sensor(s) 56 may be positioned to detect the plate leading edge and to send a signal to the electronic controller 200 to stop the movement of the belts 60 when the plate edge is detected.

Figure 19:
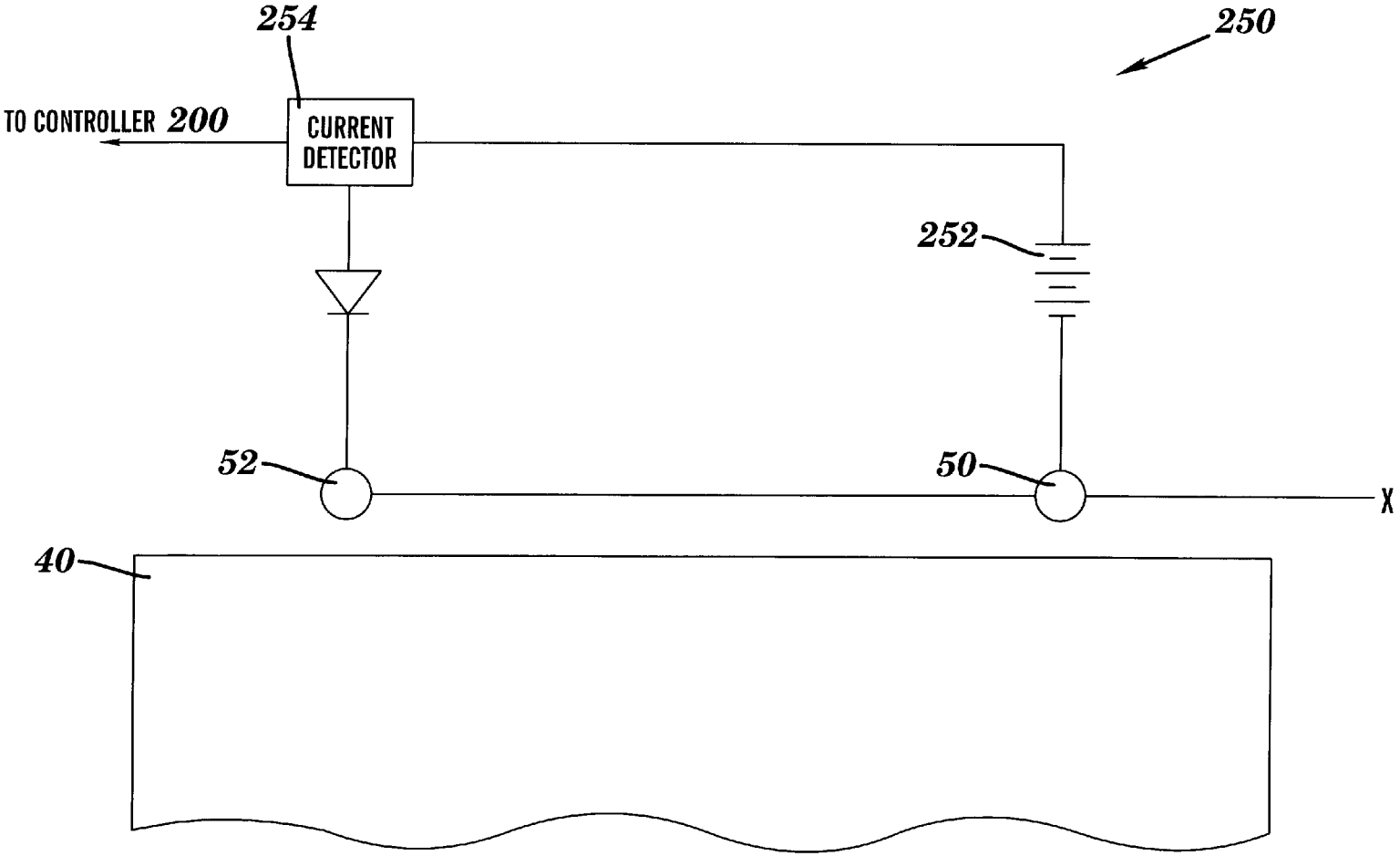
FIG. 19 shows an illustrative functional diagram of a plate detection circuit of the invention.

Also according to the invention, stops 50, 52 may be formed of a conductive material, such as metal, to provide an electrical signal to the electronic controller 200 when a conductive plate edge is in contact with each of the stops 50, 52. As shown in FIG. 19, stops 50, 52 may form contact points of an open electrical circuit 250. The circuit 250 includes a power source 252 connected to one of the two stops, e.g. 50, and to a current detector 254. The current detector 254 is connected to the other stop 52. When an edge of a conductive plate, such as an aluminum based plate, contacts both stops 50, 52 simultaneously, the conductive plate causes the circuit 250 to be closed. A current is caused to flow in the current detector 254 which sends a signal to the controller 200 indicating that the plate edge is in contact with each of the conductive pins.

Figure 20B:
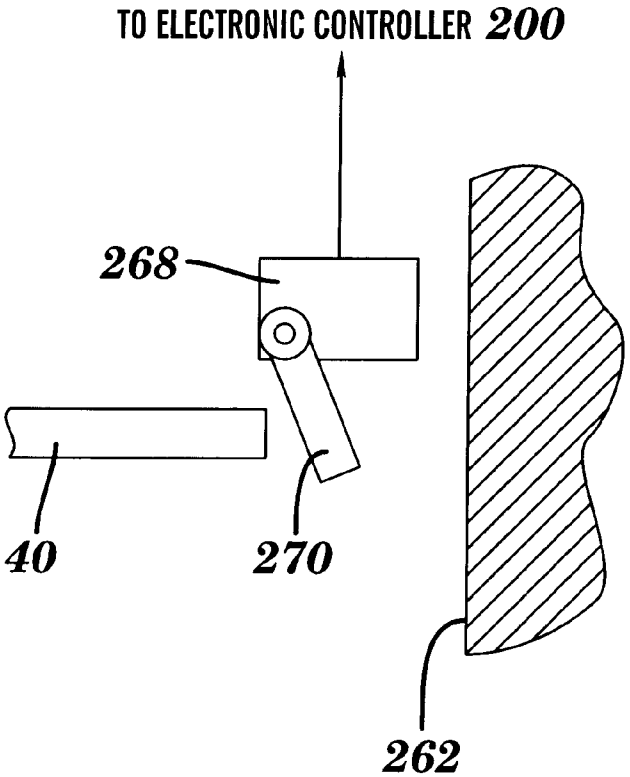
FIG. 20B shows an illustrative functional diagram of a plate detection mechanical switch of the invention.
Figure 20A:
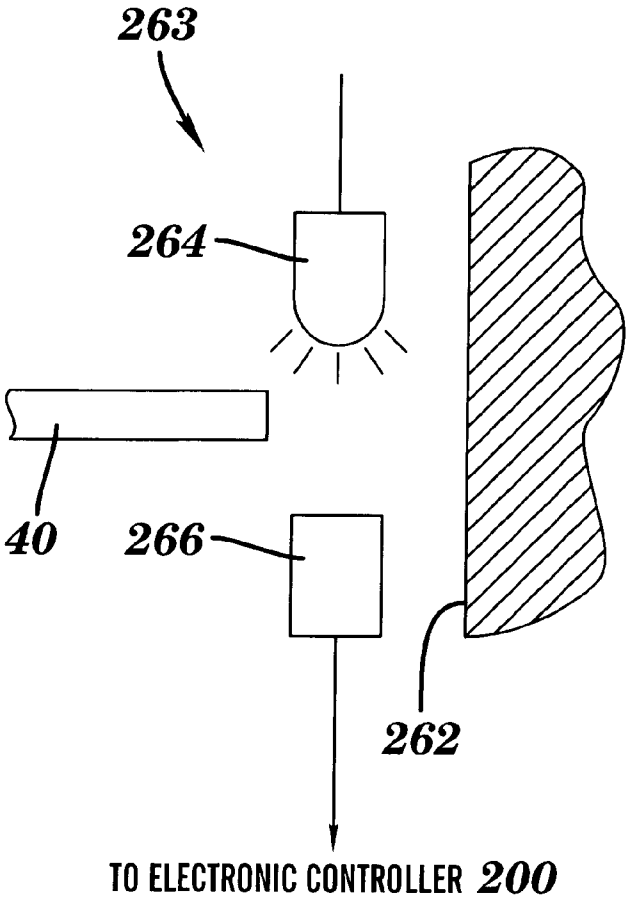
FIG. 20A shows an illustrative functional diagram of a plate detection optical switch of the invention.

In yet another embodiment, a pair of switches may be used in place of, or in addition to, stops 50, 52. One example is shown in FIG. 20A. An optical switch 263 includes an emitter 264, for emitting a radiation beam, and a receiver 266, responsive to receiving the radiation beam. When a plate 40 interrupts the beam, a signal is sent to the electronic controller 200 to stop the advancement of the plate. In addition to the optical switch, a mechanical stop 262 may be provided as a hard stop, which forms the axis "X" (not shown). Another example is shown in FIG. 20B. A mechanical switch 268 and an actuator portion 270 are provided. As the moving plate 40 advances past the actuator 270, the plate edge pushes the actuator 270 activating the switch 268. The switch portion 268 sends a signal, to the electronic controller 200, to stop the advancement of the plate. A hard mechanical stop 262 may also be provided. Other switch embodiments may also be used. Two such embodiments, which are particularly suitable for use with non-conductive plates, are disclosed in U.S. Pat. No. 5,889,547, the disclosure of which is incorporated herein by reference. The switches described above may also be used instead of the intermediate sensor 56.

Those skilled in the art will appreciate that numerous modifications and variations may be made to the above disclosed embodiments without departing from the spirit and scope of the present invention.

What is claimed is:

1. A plate handling system for use in an imaging system in which plates of recording media are fed through an imaging unit, said plate handling system comprising:

an input portion for receiving a plate from the imaging engine;

a first conveying assembly extending from said input portion to an intermediate portion, said first conveying assembly being provided to direct a plate along a first direction;

a second conveying assembly extending toward an output portion of said plate handling system, said second conveying assembly being provided to direct a plate along a second direction from said intermediate portion to said output portion, said second direction being generally perpendicular to said first direction; and a moveable frame for mounting said second conveyor assembly thereon, said frame operable to raise or lower said second conveyor assembly with respect to said first conveyor assembly.

2. The plate handling system as claimed in claim 1, wherein said first conveyor assembly includes a plurality of belts.

3. The plate handling system as claimed in claim 1, wherein said second conveyor assembly includes a plurality of rollers.

4. The plate handling system of claim 3 wherein a length of each of said rollers is greater than or equal to, a diameter of each of said rollers.

5. The plate handling system as claimed in claim 1, wherein said plate handling system includes a plurality of output portions, and wherein said first and second conveyor assemblies are provided to selectively direct a plate along said first direction toward a first output portion, and along said second direction toward a second output portion.

6. The plate handling system as claimed in claim 1, wherein said plate handling system includes a plurality of output portions, and wherein said first and second conveyor assemblies are provided to selectively direct a plate along said second direction toward a first output portion, and along the opposite of said second direction toward a second output portion.

7. A plate guide apparatus for use in an imaging system in which plates of recording media are fed through an imaging unit, said plate guide apparatus comprising:

an input portion for receiving a plate from the imaging engine, said input portion including an input sensor that provides an input signal;

a first conveying assembly extending from said input portion to an intermediate portion of said plate guide apparatus, said intermediate portion including an intermediate sensor that provides an intermediate signal, and said first conveying assembly being provided to direct a plate along a first direction responsive to said input and intermediate signals;

a second conveying assembly extending toward an output portion of said plate guide apparatus, said output portion including an output sensor that provides an output signal, and said second conveying assembly being provided to direct a plate along a second direction from said intermediate portion to said output portion responsive to said intermediate and output signals, said second direction being generally perpendicular to said first direction; and a moveable frame for mounting said second conveyor assembly thereon, said frame operable to raise or lower said second conveyor assembly with respect to said first conveyor assembly.

8. The plate guide apparatus as claimed in claim 7, wherein said first conveying assembly includes a plurality of belts.

9. The plate guide apparatus as claimed in claim 7, wherein said second conveying assembly includes a plurality of rollers.

10. The plate guide apparatus of claim 9 wherein a length of each of said rollers is greater than or equal to, a diameter of each of said rollers.

11. The plate guide apparatus as claimed in claim 7, wherein said plate guide apparatus includes a plurality of output portions, and wherein said first and second conveying assemblies are provided to selectively direct a plate along said first direction toward a first output portion, and along said second direction toward a second output portion.

12. The plate guide apparatus as claimed in claim 7, wherein said plate guide apparatus includes a plurality of output portions, and wherein said first and second conveying assemblies are provided to selectively direct a plate along said second direction toward a first output portion, and along the opposite of said second direction toward a second output portion.

13. The plate guide apparatus as claimed in claim 7, wherein said plate guide apparatus further includes a plurality of second conveying assemblies for selectively directing a plate in a direction that is generally perpendicular to said first direction toward any of a plurality of output portions.

14. The plate guide apparatus as claimed in claim 7, wherein said plate guide apparatus further includes a plurality of first conveying assemblies and of second conveying assemblies for selectively directing a plate in a direction that is generally parallel with said first direction toward any of a second output portion.

15. The plate guide apparatus as claimed in claim 7, wherein said imaging system includes a plurality of output units.

16. The plate guide apparatus as claimed in claim 7, wherein said imaging system includes a plurality of image processing units.

17. The plate guide apparatus as claimed in claim 7, wherein said plates may be processed along a length that is shorter than the length along which they are processed by the imaging engine.

18. A method of guiding plates of image recording media in an imaging system, said method comprising the steps of:

receiving a plate from an imaging engine along a first direction;

actuating a first conveyor assembly to direct said plate along said first direction;

ceasing actuation of said conveyor assembly when said plate reaches a predetermined intermediate location;

raising said second conveyor assembly with respect to said first conveyor assembly prior to actuating said second conveyor assembly;

actuating a second conveyor assembly to direct said plate along a second direction that is generally perpendicular to said first direction; and providing said plate at an output location along said second direction.

19. The method as claimed in claim 18, wherein said method further includes the step of selectively providing said plate to any of a plurality of output locations along any of said first direction, said second direction and the opposite of said second direction.

20. The method as claimed in claim 18, wherein said method further includes the step of applying notch punches to said plate while said plate is positioned at said intermediate location.

21. The method of guiding plates of claim 18 further comprising the step of;

providing at least one of said first or second conveying assemblies with a plurality of rollers for facilitating movement of said plate; and wherein a length of each of said rollers is greater than or equal to, a diameter of each of said rollers.

22. A system for recording images onto a printing plate, the system comprising:

a feed handler for feeding the printing plate into an imaging engine;

said imaging engine for recording images onto the printing plate;

a bridge handler for receiving the printing plate from the imaging engine in a first direction, then transferring the printing plate in a second direction perpendicular to the first direction to a plate processor, said handler comprising:

a first conveyor assembly for receiving the printing plate from the imaging engine in the first direction;

a second conveyor assembly for transferring the printing plate in the second direction to the plate processor; and a moveable frame for mounting said second conveyor assembly thereon, said frame operable to raise or lower said second conveyor assembly with respect to said first conveyor assembly; and said plate processor for processing the recorded images on the printing plate.

23. The system of claim 22 wherein the first conveyor assembly comprises rollers or belts.

24. The plate handling system of claim 23 wherein a length of each of said rollers is greater than or equal to, a diameter of each of said rollers.

25. The system of claim 23 wherein the second conveyor assembly comprises rollers or belts.

26. The plate handling system of claim 25 wherein a length of each of said rollers is greater than or equal to, a diameter of each of said rollers.

27. A method for recording images onto a printing plate, the method comprising:

feeding the printing plate into an imaging engine;

recording images onto the printing plate in the imaging engine;

providing a first conveyor assembly for receiving the printing plate from the imaging engine in a first direction, and a second conveyor assembly for transferring the printing plate in a second direction;

providing a moveable frame for mounting said second conveyor assembly thereon, said frame operable to raise or lower said second conveyor assembly with respect to said first conveyor assembly; and automatically receiving the imaged printing plate from the imaging engine in a first direction, then transferring the imaged printing plate to a next unit in a second direction different from the first direction.

28. The method of claim 27 wherein the next unit is a plate processor for processing the recorded images on the printing plate.

29. The method of claim 27 wherein the first direction and second direction are perpendicular to one another.

30. The method of claim 27 wherein the first conveyor assembly comprises rollers or belts.

31. The plate handling system of claim 30 wherein a length of each of said rollers is greater than or equal to, a diameter of each of said rollers.

32. The method of claim 27 wherein the second conveyor assembly comprises rollers or belts.

33. The plate handling system of claim 32 wherein a length of each of said rollers is greater than or equal to, a diameter of each of said rollers.

* * * * *